US011896140B2

(12) United States Patent
Lee

(10) Patent No.: US 11,896,140 B2
(45) Date of Patent: Feb. 13, 2024

(54) PACKABLE ASSEMBLIES AND SUPPORT MEMBERS FOR PACKABLE ASSEMBLIES

(71) Applicant: Zinus Inc., Gyeonggi-do (KR)

(72) Inventor: Dongyoung Lee, Busan (KR)

(73) Assignee: ZINUS INC., Gyeonggi-Do (KR)

( * ) Notice: Subject to any disclaimer, the term of this patent is extended or adjusted under 35 U.S.C. 154(b) by 104 days.

(21) Appl. No.: 17/592,261

(22) Filed: Feb. 3, 2022

(65) Prior Publication Data

US 2023/0200538 A1 Jun. 29, 2023

Related U.S. Application Data

(63) Continuation of application No. PCT/CN2021/142013, filed on Dec. 28, 2021.

(51) Int. Cl.

| | |
|---|---|
| ***A47C 4/02*** | (2006.01) |
| ***A47C 13/00*** | (2006.01) |
| ***A47C 17/86*** | (2006.01) |

(52) U.S. Cl.

CPC ..... *A47C 4/028* (2013.01); *A47C 4/022* (2013.01); *A47C 17/86* (2013.01)

(58) Field of Classification Search

CPC ..... A47C 4/021; A47C 4/022; A47C 4/028; A47C 13/005

See application file for complete search history.

(56) References Cited

U.S. PATENT DOCUMENTS

| | | | | |
|---|---|---|---|---|
| 2,597,860 A * | 5/1952 | Gerber | A47C 4/02 297/411.28 |
| 2,678,088 A * | 5/1954 | Jamison, Jr. | A47C 4/028 5/296 |
| 2,838,100 A | 6/1958 | Follows | |
| 3,183,036 A * | 5/1965 | Hill | A47C 4/028 297/440.22 |
| 3,578,385 A * | 5/1971 | Stiglitz | A47C 7/22 5/8 |
| 3,698,766 A * | 10/1972 | Borenstein | A47C 7/22 297/452.56 |

(Continued)

FOREIGN PATENT DOCUMENTS

| | | |
|---|---|---|
| CA | 2280215 A1 | 10/2000 |
| CN | 1448093 A | 10/2003 |

(Continued)

OTHER PUBLICATIONS

PCT/CN2021/142013 International Search Report and Written Opinion dated Sep. 22, 2022.

*Primary Examiner* — Rodney B White

(74) *Attorney, Agent, or Firm* — Wilson Sonsini Goodrich & Rosati

(57) ABSTRACT

The present disclosure provides a packable assembly comprising an apparatus. The apparatus may comprise a main body comprising one or more openings or grooves; one or more support members that are insertable into the one or more openings or grooves of the main body; one or more additional support members positioned external to or remote from the one or more openings or grooves of the main body; and one or more attachment mechanisms configured to releasably couple the one or more support members to the one or more additional support members to provide structural support for the main body.

23 Claims, 20 Drawing Sheets

(56) References Cited

U.S. PATENT DOCUMENTS

| | | | | | |
|---|---|---|---|---|---|
| 3,988,034 | A | | 10/1976 | Fister, Jr. | |
| 4,092,049 | A | * | 5/1978 | Schoblom | A47C 5/005 297/229 |
| 4,588,227 | A | * | 5/1986 | Austin | A47C 5/10 403/255 |
| 5,000,512 | A | * | 3/1991 | Laird | A47C 4/028 297/440.22 |
| 5,277,476 | A | * | 1/1994 | Caldwell | A47C 4/028 297/440.13 |
| 7,213,885 | B2 | * | 5/2007 | White, III | A47C 4/028 297/440.16 |
| 8,783,778 | B2 | * | 7/2014 | Nelson | A47C 13/005 403/395 |
| 10,123,623 | B2 | * | 11/2018 | Nelson | F16B 12/00 |
| 10,433,648 | B1 | * | 10/2019 | Kuhl | A47C 17/86 |
| 10,512,338 | B1 | * | 12/2019 | Hawkins | A47C 19/027 |
| 10,932,581 | B1 | * | 3/2021 | Hawkins | A47C 19/027 |
| 11,297,949 | B1 | * | 4/2022 | Galjour | A47C 4/028 |
| 11,607,044 | B2 | * | 3/2023 | Brandtner | A47C 7/52 |
| 11,612,253 | B2 | * | 3/2023 | Caron | A47C 4/028 297/440.14 |
| 2017/0027326 | A1 | * | 2/2017 | Gharabegian | A47C 4/022 |
| 2017/0367486 | A1 | * | 12/2017 | Nelson | A47C 13/005 |
| 2018/0213943 | A1 | * | 8/2018 | Kuhl | A47C 7/407 |
| 2020/0107643 | A1 | * | 4/2020 | Kuhl | A47C 13/005 |
| 2020/0268160 | A1 | * | 8/2020 | Kuhl | A47C 15/002 |
| 2021/0093087 | A1 | * | 4/2021 | Zei | A47C 4/028 |
| 2021/0289941 | A1 | | 9/2021 | Brandtner et al. | |
| 2022/0000266 | A1 | * | 1/2022 | Nelson | A47C 13/005 |
| 2022/0022657 | A1 | * | 1/2022 | Kuhl | A47C 17/86 |
| 2022/0354262 | A1 | * | 11/2022 | Kuhl | A47C 15/002 |
| 2023/0038420 | A1 | * | 2/2023 | Eglinton | A47C 4/02 |
| 2023/0067292 | A1 | * | 3/2023 | Altemimei | A47C 17/04 |

FOREIGN PATENT DOCUMENTS

| | | | | | |
|---|---|---|---|---|---|
| CN | 206621115 | U | | 11/2017 | |
| CN | 108477914 | A | | 9/2018 | |
| CN | 209898823 | U | | 1/2020 | |
| CN | 213128772 | U | | 5/2021 | |
| DE | 202008002395 | U1 | * | 7/2008 | A47C 11/00 |
| GB | 2323275 | A | * | 9/1998 | A47C 4/022 |
| JP | 07231831 | A | * | 9/1995 | A47C 4/022 |
| JP | 2000350639 | A | | 12/2000 | |
| JP | 2004230085 | A | | 8/2004 | |
| JP | 2013055991 | A | | 3/2013 | |
| KR | 200303068 | Y1 | | 2/2003 | |
| KR | 200467754 | Y1 | | 7/2013 | |
| TW | 278310 | U | * | 10/2005 | A47C 4/022 |
| WO | WO-2021092642 | A1 | | 5/2021 | |
| WO | WO-2023122942 | A1 | | 7/2023 | |

* cited by examiner

PACKABLE ASSEMBLIES AND SUPPORT MEMBERS FOR PACKABLE ASSEMBLIES

CROSS-REFERENCE

This application is a continuation application of International Patent Application No. PCT/CN2021/142013 filed on Dec. 28, 2021, which application is incorporated herein by reference in its entirety for all purposes.

BACKGROUND

Articles of furniture may be difficult to transport and deploy if they cannot be folded for carrying or storage purposes, or compressed into a small volume. The packability and transportability of articles of furniture is important for shipping/transport and storage purposes. Packable articles of furniture may require one or more supporting structures (e.g., frames, bars, or other load-bearing members) to provide support and stability during use.

SUMMARY

The present disclosure provides packable assemblies and support members for packable assemblies. The packable assemblies may comprise one or more articles of furniture. The packable assemblies may comprise one or more components of one or more articles of furniture. The articles of furniture may comprise, for example a loveseat, a sofa, a chair, a chaise, or any other type of furniture that is usable to support a load (e.g., a load exerted by an object or an end user sitting or lying on the article of furniture). The presently disclosed support members for the packable assemblies may be configured to provide additional structural support for the packable assemblies once the packable assemblies are deployed by a consumer. The support members may be separable from other components of the one or more packable assemblies to enhance transportability and packability without comprising on build quality, comfort, or structural integrity/stability. The support members may be easily integrated with and/or decoupled from the other components of the one or more packable assemblies, without requiring the use of specialized tools or complex assembly or disassembly procedures.

Commercially available articles of furniture typically compromise on build quality, comfort, and/or structural integrity or stability to improve transportability and packability. Recognized herein are various limitations with packable furniture assemblies currently available. The present disclosure aims to address the shortcomings and technical disadvantages of commercially available packable furniture assemblies by providing apparatuses that can be easily dis-assembled and packed into a compact volume for storage or shipping/transport, without comprising on build quality, structural stability, or end user comfort. The packable assemblies, support members, and other apparatuses disclosed herein may provide manufactures, shippers, and/or suppliers the ability to separate a first portion of an article of furniture from a second portion of the article of furniture for ease of storage and/or transport, which first portion may comprise a body of the article of furniture, and which second portion may comprise one or more structural components of the article of furniture. The packable assemblies, support members, and other apparatuses disclosed herein may also provide end users (e.g., consumers) the ability to integrate the second portion of the article of furniture with the first portion of the article of furniture to form the article of furniture and provide additional support, stability, or comfort when using the article of furniture.

In one aspect, the present disclosure provides an apparatus, comprising: a main body comprising one or more openings or grooves; one or more support members that are insertable into the one or more openings or grooves of the main body; one or more additional support members positioned external to or remote from the one or more openings or grooves of the main body; and one or more attachment mechanisms configured to releasably couple the one or more support members to the one or more additional support members to provide structural support for the main body. In some embodiments, the one or more additional support members comprise one or more holes through which at least a portion of the one or more attachment mechanisms is insertable. In some embodiments, the one or more attachment mechanisms are insertable through the one or more holes of the additional support members to couple the one or more additional support members to the one or more support members.

In some embodiments, the apparatus further comprises one or more leg members coupled to or integrated with the one or more attachment mechanisms. In some embodiments, the one or more attachment mechanisms are (i) insertable through the one or more holes of the additional support members and (ii) configured to couple the one or more leg members and/or the one or more additional support members to the one or more support members. In some embodiments, the one or more attachments mechanisms comprise the one or more leg members. In some embodiments, the one or more additional support members are configured as one or more leg supports that raise the main body relative to a surface on which the one or more additional support members are placed. In some embodiments, the one or more attachment mechanisms comprise a screw or a bolt.

In some embodiments, the one or more support members are positioned and oriented at an angle relative to the one or more additional support members. In some embodiments, the one or more support members are perpendicular or orthogonal to the one or more additional support members. In some embodiments, the one or more attachment mechanisms are configured to limit or restrict a movement of the one or more support members relative to the one or more additional support members when the one or more attachment mechanisms are inserted through the one or more holes of the one or more additional support members to couple the one or more additional support members to the one or more support members.

In some embodiments, the apparatus further comprises (i) a second body comprising one or more openings or grooves and (ii) one or more lateral support members that are insertable into the one or more openings or grooves of the second body. In some embodiments, the apparatus further comprises (iii) one or more additional lateral support members positioned external to or remote from the one or more openings or grooves of the second body and (iv) one or more additional attachment mechanisms configured to releasably couple the one or more lateral support members to the one or more additional lateral support members to provide structural support for the second body. In some embodiments, the one or more additional attachment mechanisms comprise a screw or a bolt.

In some embodiments, the apparatus further comprises one or more additional leg members coupled to or integrated with the one or more additional attachment mechanisms. In some embodiments, the one or more additional attachment mechanisms are (i) insertable through one or more holes of the one or more additional lateral support members and (ii) configured to couple the one or more additional leg members and/or the one or more additional lateral support members to the one or more lateral support members. In some embodiments, the one or more additional attachment mechanisms comprise the one or more additional leg members. In some embodiments, the one or more additional lateral support members are configured as one or more additional leg supports that raise the second body relative to a surface on which the one or more additional lateral support members are placed.

In some embodiments, the apparatus further comprises one or more connectors configured to releasably couple the main body to the second body. In some embodiments, the one or more connectors comprise a latch. In some embodiments, the latch is configured to releasably couple at least one leg member of the main body to at least one leg member of the second body to limit or restrict a movement of the main body relative to the second body.

In some embodiments, the main body comprises a foam material. In some embodiments, the main body is vacuum packable. In some embodiments, the main body comprises at least a portion of an article of furniture. In some embodiments, the article of furniture comprises a sofa, a loveseat, or a chair.

In another aspect, the present disclosure provides an apparatus comprising: a main body; one or more armrests; and one or more connecting mechanisms for coupling or securing the one or more armrests to one or more structural components inserted through or within one or more grooves of the main body. In some embodiments, at least a portion of the one or more connecting mechanisms is insertable into one or more grooves of the one or more armrests.

In some embodiments, the one or more connecting mechanisms comprise one or more wedges secured to one or more plates, wherein the one or more plates are insertable into the one or more armrests to provide structural support for the one or more armrests. In some embodiments, the apparatus further comprises an additional set of wedges configured to engage with the one or more wedges secured to the one or more plates in order to limit or restrict a movement of the one or more armrests relative to the main body. In some embodiments, the one or more plates are configured to couple to the one or more structural components coupled to or inserted through or within the main body to limit or restrict a movement of the one or more armrests relative to the main body, wherein the one or more structural components comprise one or more support members for the main body. In some embodiments, the one or more support members are insertable into the main body. In some embodiments, the one or more support members extend along a length of the main body. In some embodiments, the one or more support members extend along a width of the main body. In some embodiments, the one or more additional wedges are configured to couple or attach to the one or more structural components coupled to or inserted through or within the main body, wherein the one or more structural components comprise one or more support members for the main body.

In some embodiments, at least one of (i) the main body or (ii) the one or more armrests comprises a foam material. In some embodiments, the foam material is vacuum packable.

In another aspect, the present disclosure provides a method, comprising: (a) providing an article of furniture, wherein the article of furniture comprises a main body comprising one or more openings or grooves; (b) inserting one or more support members into the one or more openings or grooves of the main body; and (c) releasably coupling one or more additional support members to the one or more support members using one or more attachment mechanisms in order to provide structural support for the main body, wherein the one or more additional support members are positioned external to or remote from the one or more openings or grooves. In some embodiments, the article of furniture comprises a sofa, a loveseat, or a chair. In some embodiments, the main body comprises a foam material. In some embodiments, the main body is vacuum packable. In some embodiments, the one or more openings or grooves of the main body are formed by foam auto cutting.

In some embodiments, the one or more attachment mechanisms are (i) insertable through one or more holes in the additional support members and (ii) configured to couple the one or more additional support members to the one or more support members. In some embodiments, the one or more attachment mechanisms comprise a screw or a bolt.

In some embodiments, the method may further comprise using one or more connectors to releasably couple the main body to a second body corresponding to another portion of the article of furniture or another article of furniture. In some embodiments, the one or more connectors comprise a latch configured to releasably couple at least one leg member of the main body to at least one leg member of the second body to limit or restrict a movement of the main body relative to the second body.

In some embodiments, the method may further comprise inserting one or more plates into one or more armrests of the main body to provide structural support for the one or more armrests. In some embodiments, the one or more plates have one or more wedges secured thereto, and the one or more wedges are configured to couple to one or more support members inserted within the main body to limit or restrict a movement of the one or more armrests relative to the main body.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings (also "Figure" and "FIG." herein), of which:

DETAILED DESCRIPTION

While various embodiments of the invention have been shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

The present disclosure addresses the shortcomings and technical disadvantages of commercially available articles of furniture, which may be difficult to ship in compact volumes. Further, many commercially available articles of packable furniture may compromise on structural stability or overall build quality to enhance transportability, which may be dangerous and/or uncomfortable for end users or consumers.

Disclosed herein are various examples of an apparatus that can be packed into a compact volume for storage or shipping/transport, without comprising on build quality, structural stability, or end user comfort. The packable assemblies, support members, and other apparatuses of the present disclosure may provide manufactures, shippers, and/or suppliers the ability to separate a first portion of an article of furniture from a second portion of the article of furniture for ease of storage and/or transport, which first portion may comprise a body of the article of furniture, and which second portion may comprise one or more structural components of the article of furniture. The packable assemblies, support members, and other apparatuses disclosed herein may also provide end users (e.g., consumers) the ability to integrate the second portion of the article of furniture with the first portion of the article of furniture to form the article of furniture and provide additional support, stability, or comfort when using the article of furniture.

Whenever the term "at least," "greater than," or "greater than or equal to" precedes the first numerical value in a series of two or more numerical values, the term "at least," "greater than" or "greater than or equal to" applies to each of the numerical values in that series of numerical values. For example, greater than or equal to 1, 2, or 3 is equivalent to greater than or equal to 1, greater than or equal to 2, or greater than or equal to 3.

Whenever the term "no more than," "less than," or "less than or equal to" precedes the first numerical value in a series of two or more numerical values, the term "no more than," "less than," or "less than or equal to" applies to each of the numerical values in that series of numerical values. For example, less than or equal to 3, 2, or 1 is equivalent to less than or equal to 3, less than or equal to 2, or less than or equal to 1.

Packable Assembly

Figure 1:
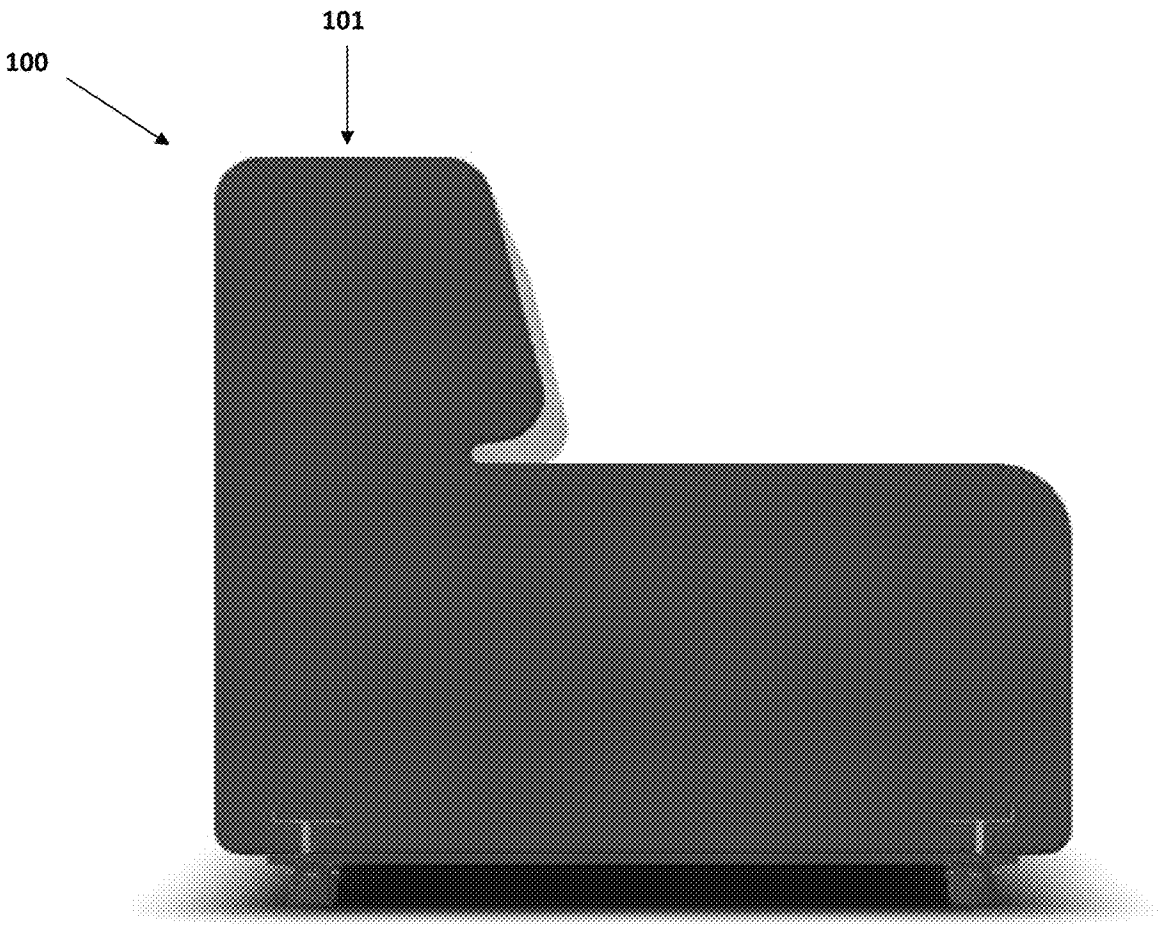
FIGS. 1-2 schematically illustrate an apparatus comprising a main body and one or more support members, in accordance with some embodiments.
Figure 5:
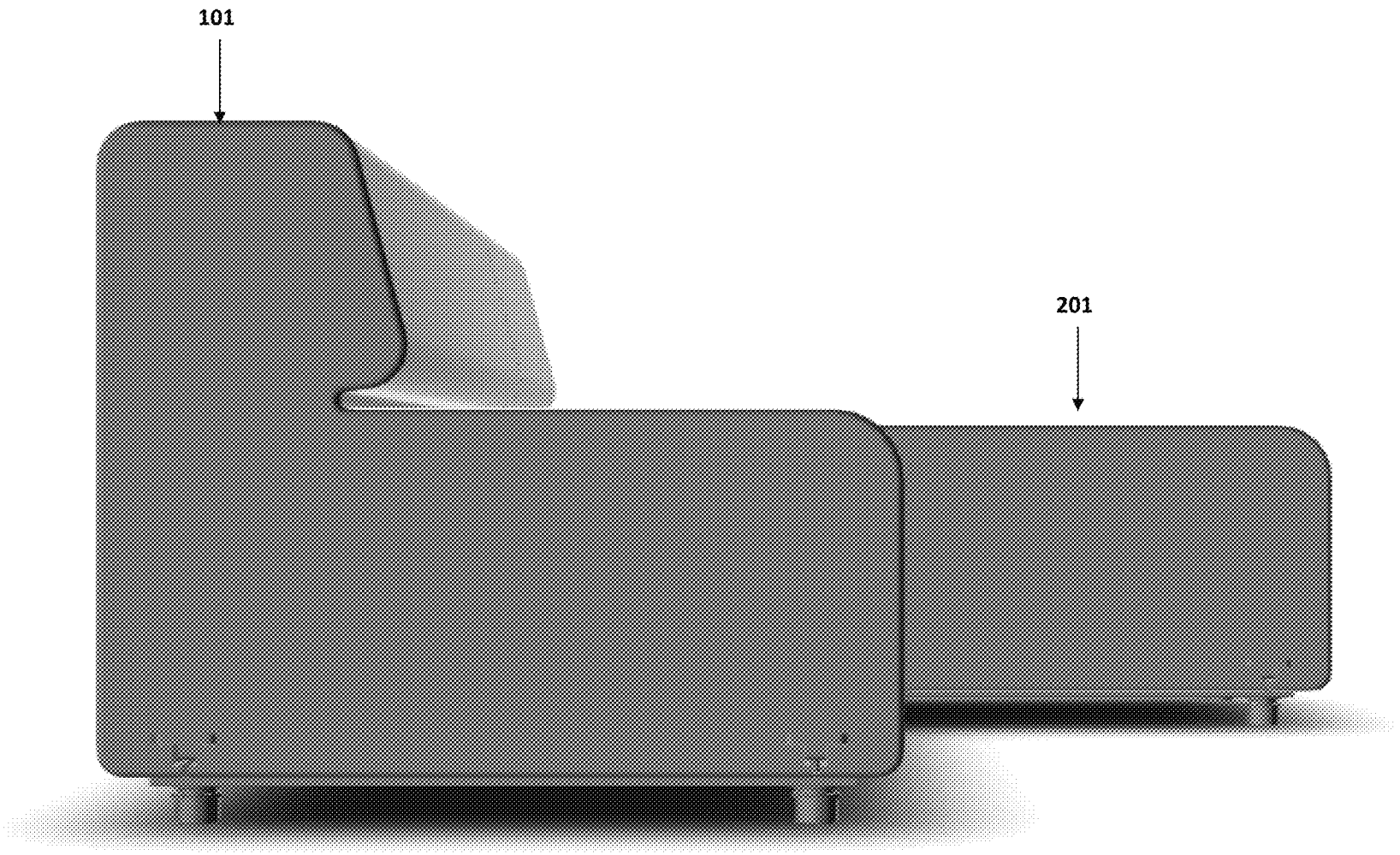
FIGS. 5-7 schematically illustrate an apparatus comprising a main body and a second body, in accordance with some embodiments.
Figure 6:
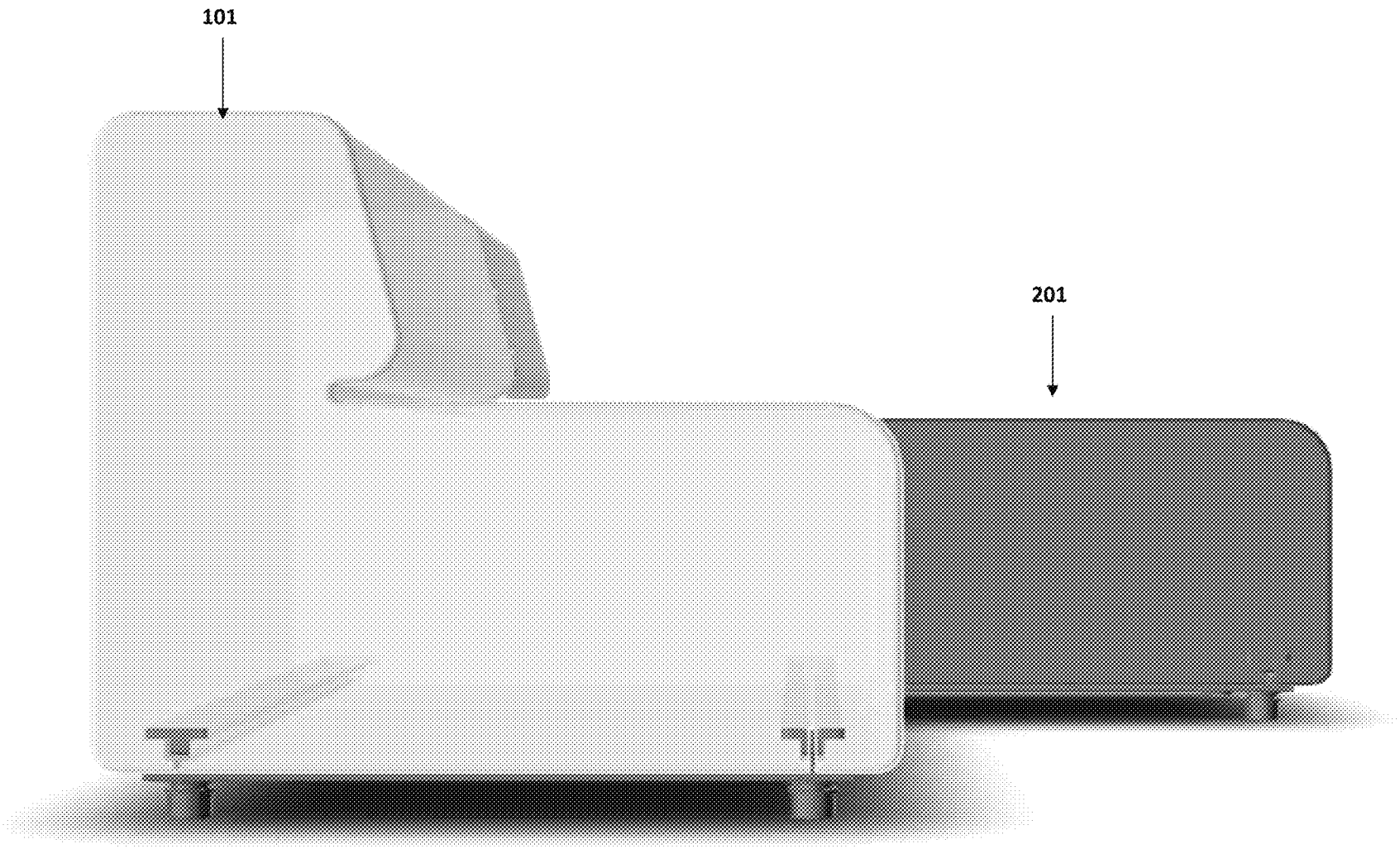
Figure 7:
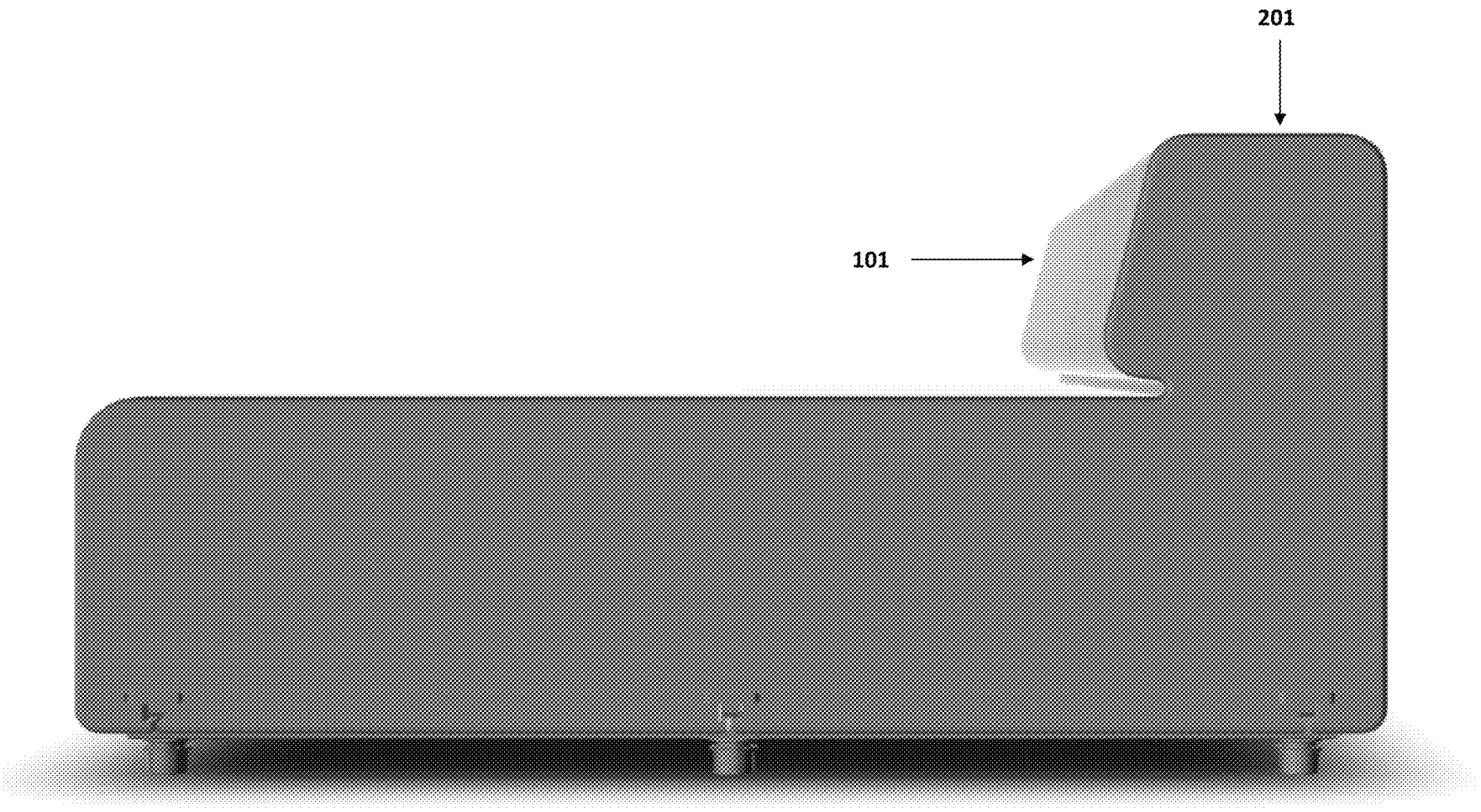
Figure 13:
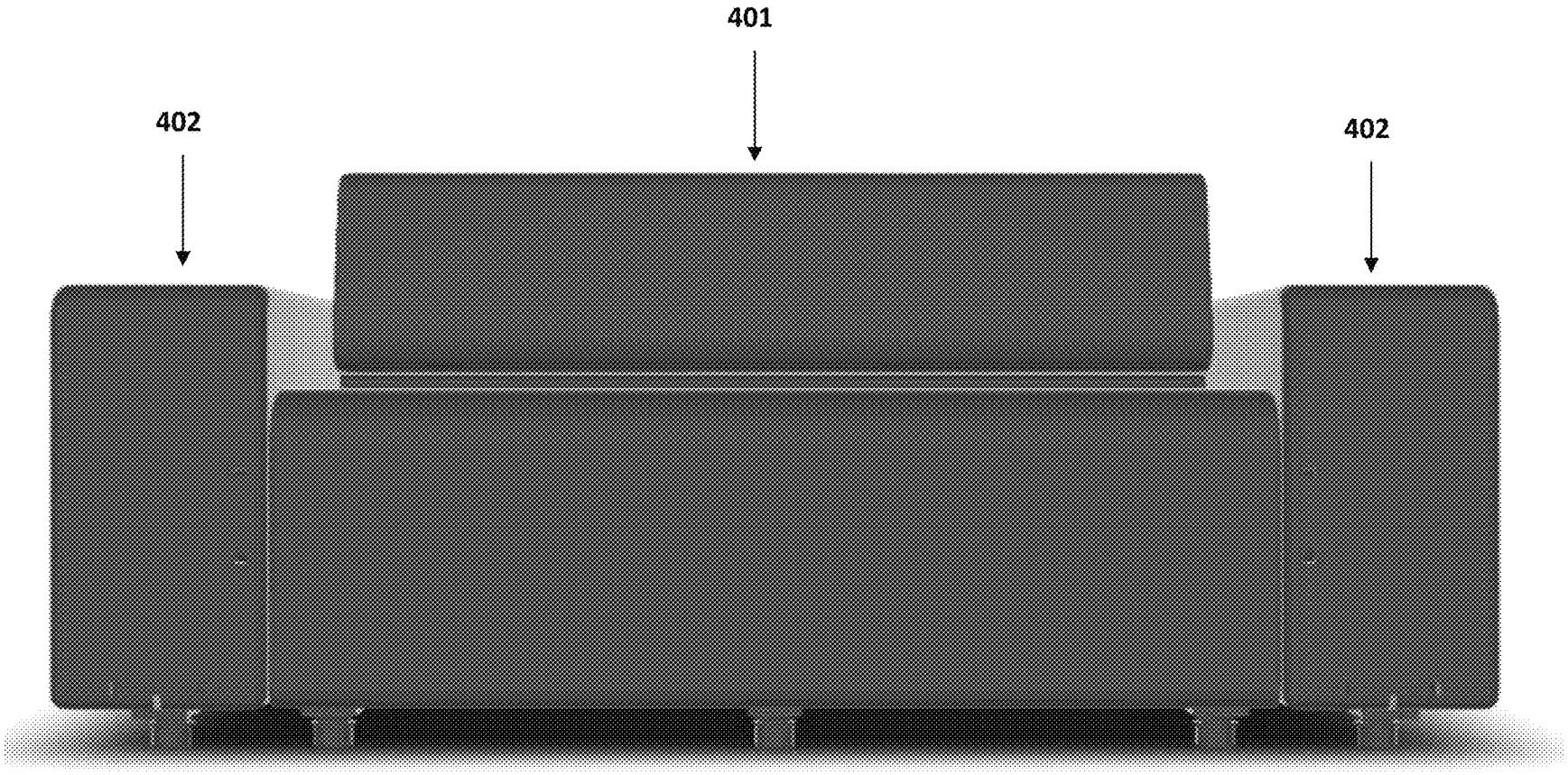
FIGS. 13-14 schematically illustrate an apparatus comprising one or more armrests, in accordance with some embodiments.

In an aspect, the present disclosure provides a packable assembly. An example of the packable assembly is illustrated in FIG. 1, FIG. 5, and FIG. 13. The packable assembly may comprise an apparatus comprising a main body having one or more openings or grooves. In some embodiments, the apparatus may further comprise one or more support members that are insertable into the one or more openings or grooves of the main body. In some embodiments, the apparatus may further comprise one or more additional support members positioned external to or remote from the one or more openings or grooves of the main body. In some embodiments, the apparatus may further comprise one or more attachment mechanisms configured to releasably couple the one or more support members to the one or more additional support members to provide structural support for the main body.

Main Body

Referring to FIG. 1, the packable assembly may comprise an apparatus 100 comprising a main body 101. The main body 101 may comprise at least a portion of an article of furniture. The article of furniture may be, for example, a sofa, a loveseat, or a chair.

In some cases, the main body may comprise a foam material. The foam material may comprise, for example, a polyurethane foam, a polyethylene foam, a cross-linked polyethylene foam, or a reticulated foam. The foam material may comprise any type of open cell foam. Alternatively, the foam material may comprise any type of closed cell foam.

In some cases, the main body may be vacuum packable. The vacuum packable main body may be capable of a volumetric compression ratio of X:1, wherein X ranges from 1.1 to 100, and wherein X represents the factor by which the volume of the uncompressed foam body is reduced when the foam body is compressed (e.g., using a vacuum packing device or system).

Openings/Grooves

Figure 2:
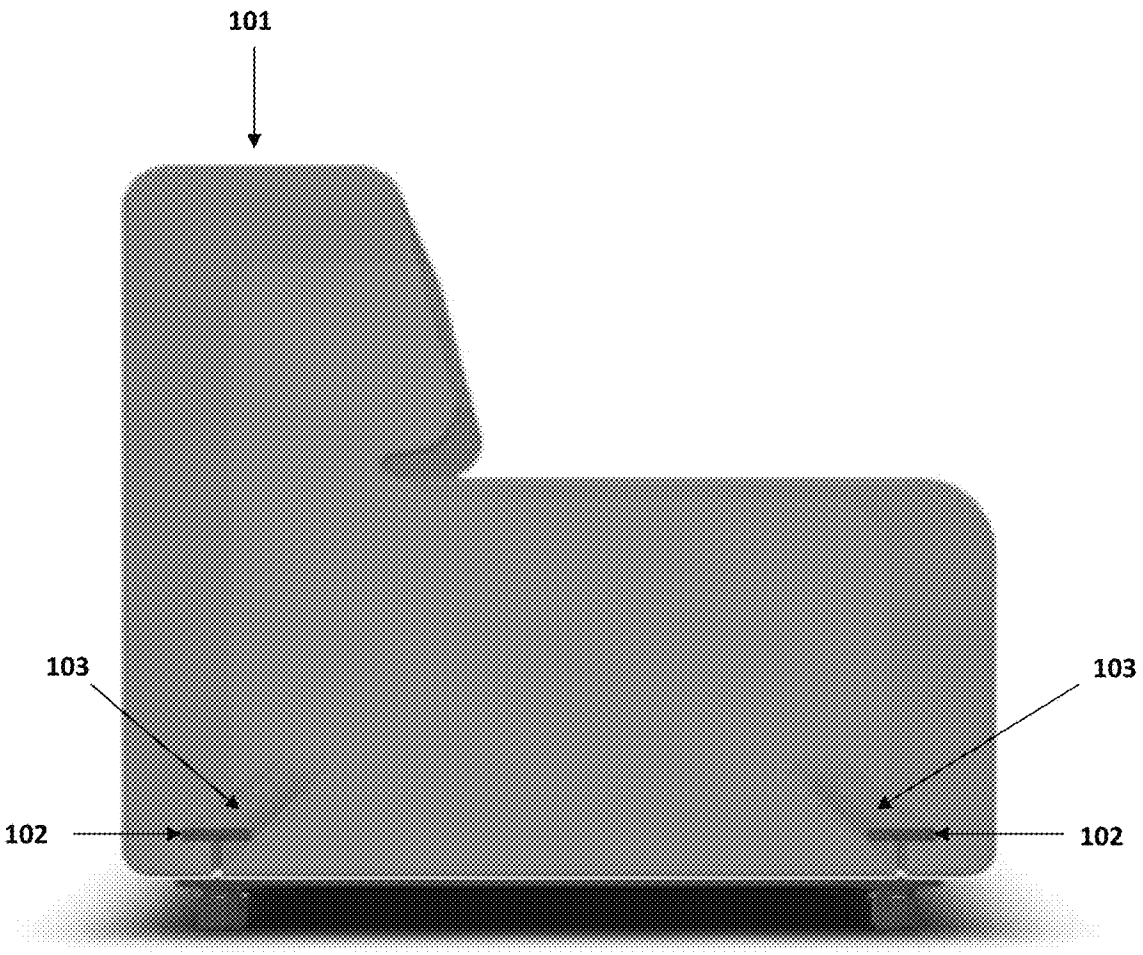

In some embodiments, the main body may comprise one or more openings or grooves. As shown in FIG. 2, the main body 101 may comprise one or more openings or grooves 102 extending through at least a portion of the main body 101. The one or more openings or grooves 102 may be sized and shaped to receive one or more support members 103. The one or more support members 103 may be insertable into the one or more grooves 102 of the main body 101. Once inserted into the one or more grooves 102, the one or more support members 103 may extend through at least a portion of the main body 101. In some cases, the one or more support members 103 may extend through a length, a width, and/or a height of the main body 101 or any other component of the apparatus/packable assembly that is attached to or integrated with the main body 101 (e.g., a second body and/or one or more armrests as described elsewhere herein).

In any of the embodiments described herein, the openings or grooves may provide a channel or passageway between a first portion or surface of the main body (or the second body) and a second portion or surface of the main body (or the second body). The channel or passageway may permit an object (e.g., a support member or any other appropriately sized and shaped structural component) to pass through the main body (or the second body). In some cases, the channel or passageway may permit an object to be inserted into or through at least a portion of the main body (or the second body).

In any of the embodiments described herein, the openings or grooves may comprise, for example, a cut out in or through the main body or the second body. The cut out may extend at least partially through a portion or a volume of the main body or the second body. In some cases, the openings or grooves may comprise a cut out that extends all the way through the main body or the second body. In other cases, the openings or grooves may comprise a cut out that only extends partially through the main body or the second body. In some cases, the openings or grooves may comprise a slit or a slot within the main body or the second body. The slit or slot may be sized and/or shaped to receive an object (e.g., a support member as described elsewhere herein). In some cases, the openings or grooves may comprise an opening through which a support member may be inserted (e.g., the support members or lateral support members described elsewhere herein). In some cases, the openings or grooves may comprise a hole through which the support members may be inserted. In any of the embodiments described herein, the openings or grooves may permit an object (e.g., a support member or any other appropriately sized and shaped structural component) to pass through the main body or the second body. In some cases, the openings or grooves may provide a channel or passageway that permits an object to be inserted into or through at least a portion of the main body or the second body.

The openings or grooves may comprise a variety of different shapes and sizes. For example, the openings or grooves may comprise a linear profile and/or a curved profile. In some cases, the openings or grooves may comprise a plurality of linear portions, a plurality of curved portions, or any combination of linear and curved portions. In some cases, the openings or grooves may comprise two or more linear portions that intersect or coincide with each other. The two or more linear portions may form, for example, an L-shaped opening or groove. Alternatively, the two or more linear portions may form, in some non-limiting embodiments, a T-shaped opening or groove.

The openings or grooves described herein may comprise any cross-sectional shape or profile. The cross-sectional shape or profile may comprise a regular shape or an irregular shape having three or more sides. The cross-sectional shape may not or need not be symmetrical. The cross-sectional shape or profile may comprise any combination of linear and non-linear portions or regions. In some cases, the cross-sectional shape may comprise rounded edges, chamfered edges, or filleted edges. In other cases, the cross-sectional shape may comprise one or more straight edges or corners.

In some embodiments, the openings or grooves may comprise an L-shaped opening or groove. The L-shaped opening or groove may comprise a first portion that extends along a longitudinal length of the main body or the second body and a second portion that is perpendicular to the first portion. In some cases, the opening or groove may comprise a T-shaped opening or groove. The T-shaped opening or groove may comprise a first portion that extends along a longitudinal length of the main body or the second body and a second portion that is perpendicular to the first portion.

In some cases, the openings or grooves may comprise a plurality of openings or grooves that are disposed adjacent to and in parallel with respect to one another (e.g., to form an aggregate shape). The plurality of openings or grooves may comprise a same or similar shape. In some cases, the plurality of openings or grooves may comprise different sizes and/or different shapes.

In some cases, the plurality of openings or grooves may comprise a longitudinal portion and one or more portions that are disposed at an angle relative to the longitudinal portion. The one or more portions that are disposed at an angle relative to the longitudinal portion may comprise two or more portions that are distributed or arranged along a length of the longitudinal portion. In some cases, the two or more portions that are disposed at an angle relative to the longitudinal portion may be (i) positioned along different parts or regions of the longitudinal portion and/or (ii) angled at different orientations relative to the longitudinal portion. In other cases, the two or more portions that are disposed at an angle relative to the longitudinal portion may be (i) positioned along a same part or region of the longitudinal portion and/or (ii) angled at a same orientation relative to the longitudinal portion.

In some cases, the openings or grooves may be sized and shaped to permit an object (e.g., a support member or a lateral support member) to be inserted through the main body. In some cases, a cross-sectional shape of the openings or grooves may comprise a same or similar shape as the support members of the present disclosure.

Figure 20:
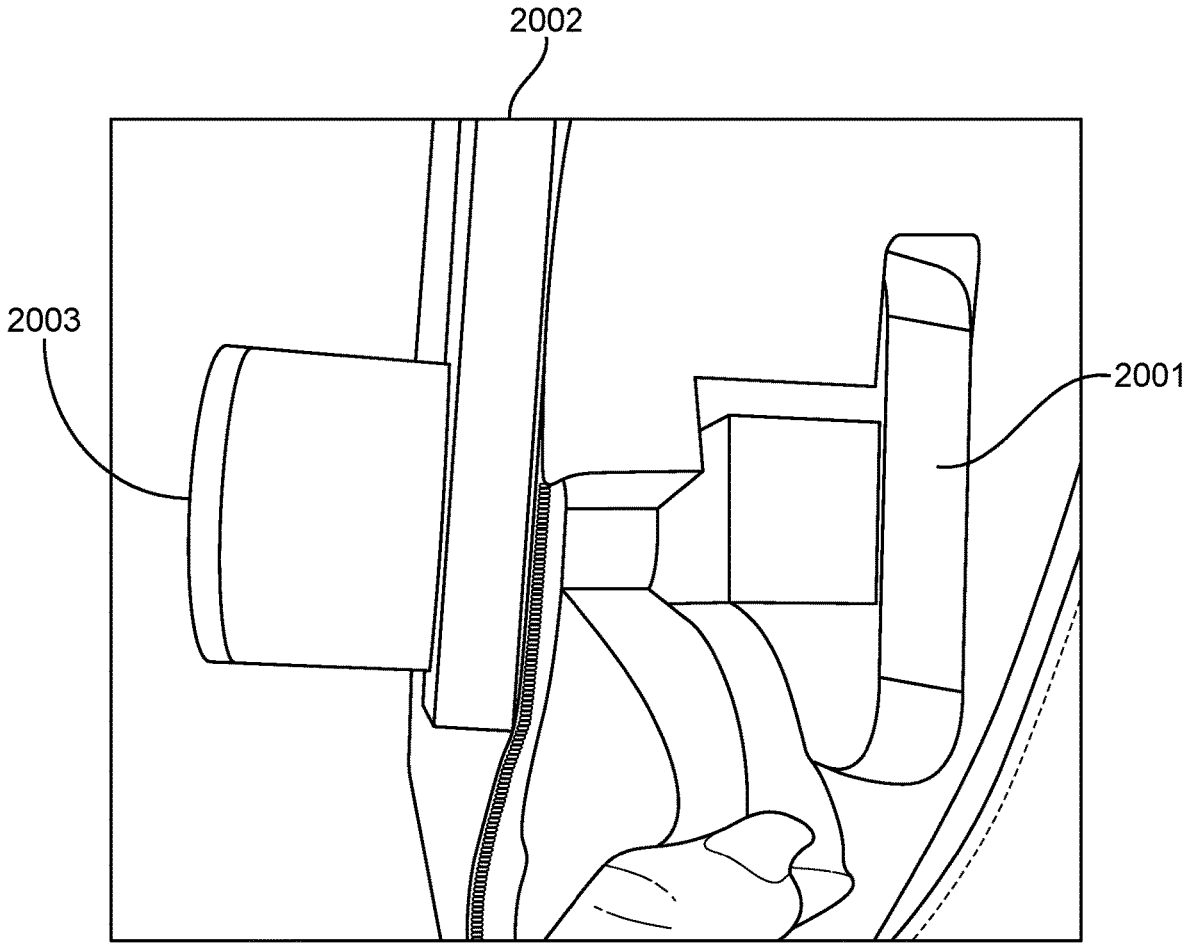
FIG. 20 schematically illustrates an example of a plate having a T-shaped cross-section, in accordance with some embodiments.

In some cases, the openings or grooves may be formed by foam auto cutting. In some cases, the perimeters of the openings or grooves formed by foam auto cutting may not be totally enclosed. For instance, as shown in FIG. 20, the openings or grooves may be formed by two or more separable pieces or portions of foam, which pieces or portions may be separable to form a gap that allows an attachment mechanism to couple or attach to the support members or lateral support members inserted into the openings or grooves of the main body and/or the second body.

Support Members/Additional Support Members

In some embodiments, the apparatus may further comprise one or more support members that are insertable into the one or more openings or grooves of the main body. In some embodiments, the one or more support members may be positioned and oriented at an angle relative to one or more additional support members that are located outside of the one or more openings or grooves. In some cases, the one or more support members may be perpendicular or orthogonal to the one or more additional support members.

In some embodiments, the apparatus may further comprise one or more additional support members positioned external to or remote from the one or more openings or grooves of the main body. In some cases, the one or more additional support members may comprise one or more holes through which at least a portion of the one or more attachment mechanisms is insertable to secure the support members and the additional support members. In some cases, the one or more additional support members may be configured as one or more leg supports that raise the main body relative to a surface on which the one or more additional support members are placed.

The support members described and referred to herein may provide support for at least a portion of the apparatus or the main body. In any of the embodiments described herein, the one or more support members may be configured to provide additional structural support and rigidity for multiple portions of an article of furniture (e.g., the top, bottom, front, back, left, and/or right portions of the article of furniture).

Figure 3:
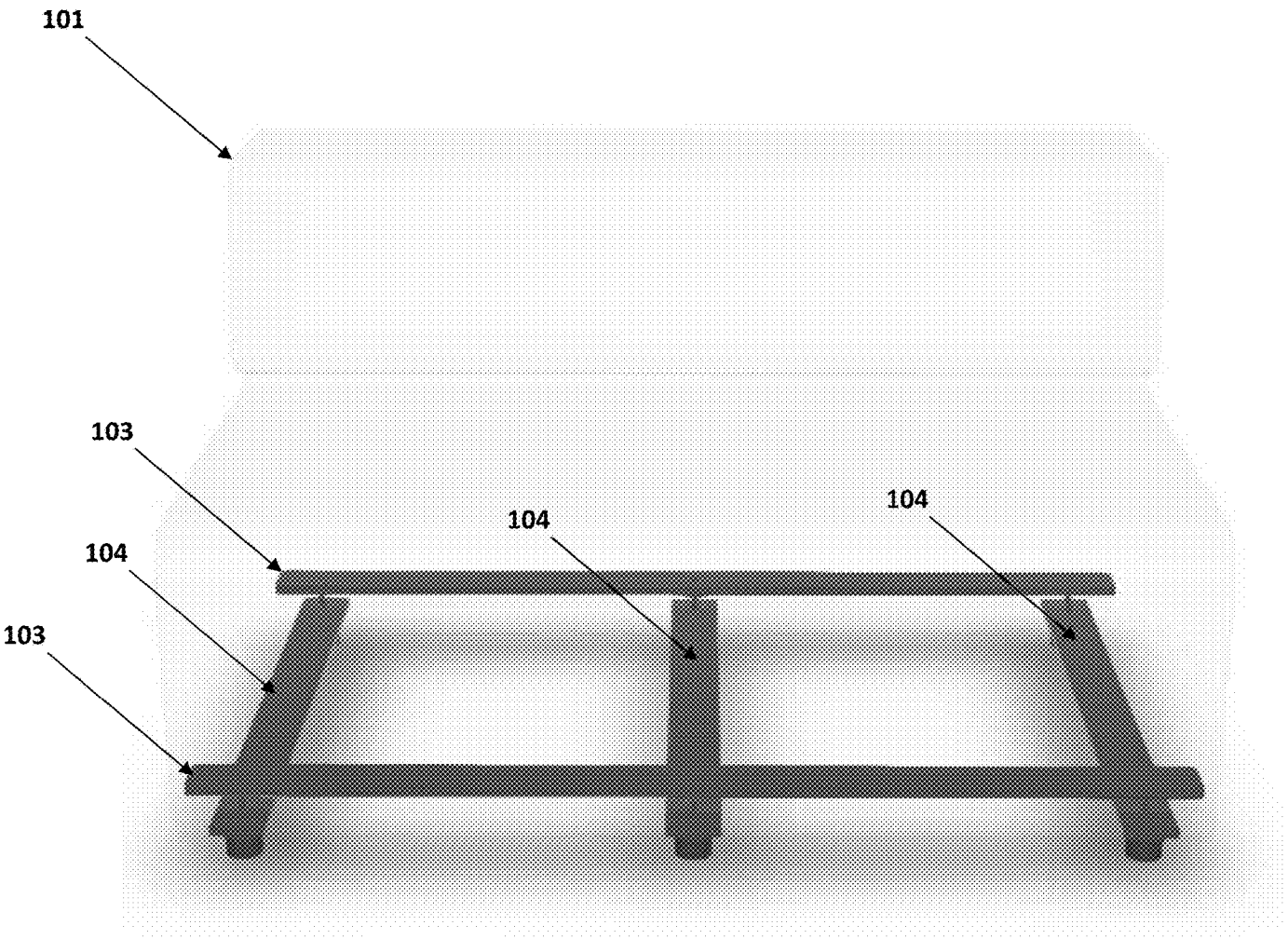
FIGS. 3-4 schematically illustrate one or more support members and one or more additional support members that are coupled together using one or more attachment mechanisms, in accordance with some embodiments.
Figure 4:
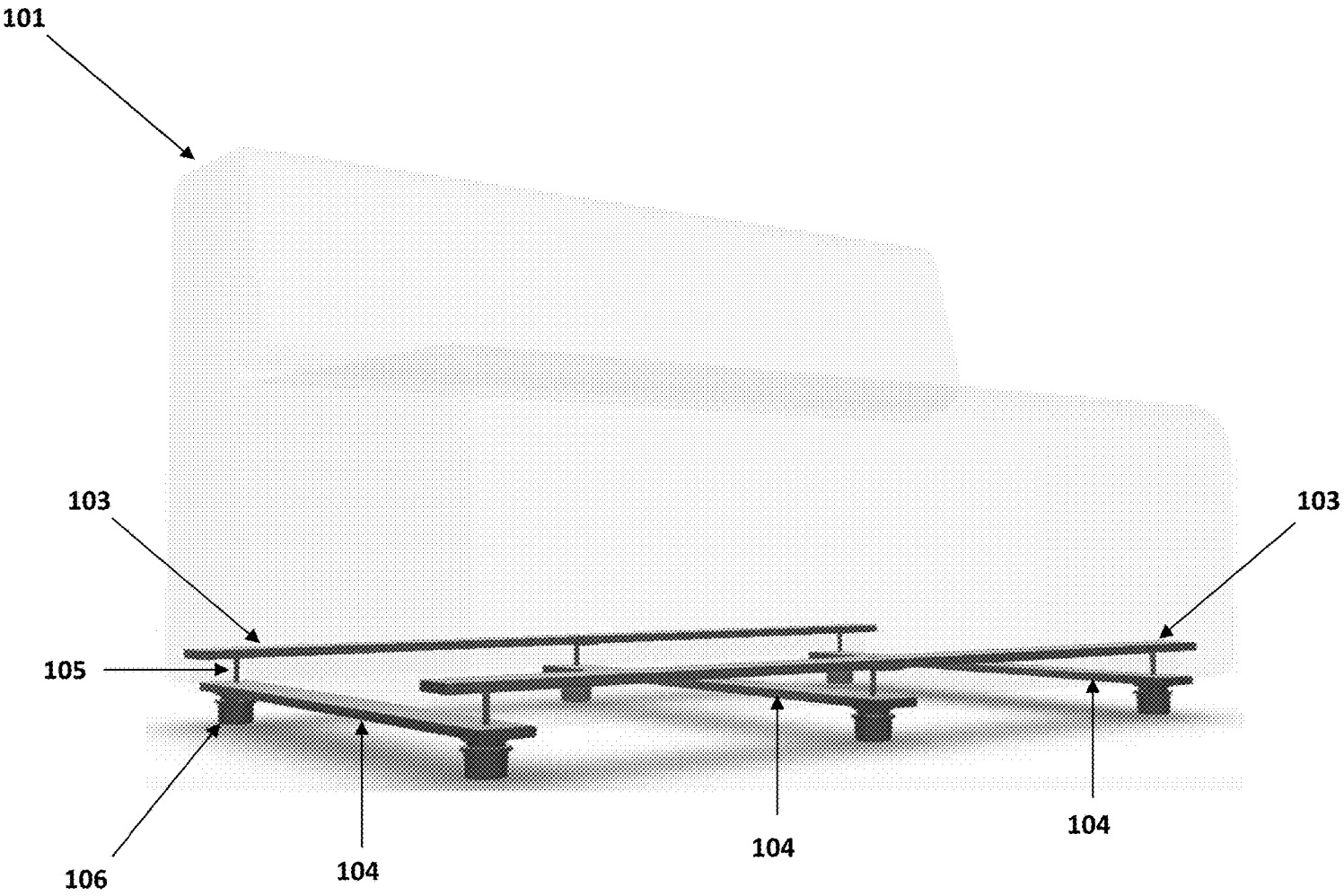

FIG. 3 and FIG. 4 illustrate one or more support members 103 and one or more additional support member 104 that may be used to provide additional structural support for the main body 101. The one or more support members 103 may be insertable into one or more openings or grooves of the main body 101. The one or more additional support members 104 may be located outside of the one or more grooves of the main body 101. The one or more support members 103 and the one or more additional support members 104 may be coupled to each other using one or more attachment mechanisms 105, as shown in FIG. 4.

In any of the embodiments described herein, the support members and/or the additional support members may comprise an elongated component. The elongated component may comprise a beam or member having any cross-sectional shape. For example, the elongated component may have a cross-sectional shape comprising a circle, an ellipse, an oval, or any polygon having three or more sides. In some non-limiting embodiments, the polygon may comprise a triangle, a square, a rectangle, a pentagon, a hexagon, a heptagon, or an octagon. In some cases, the cross-sectional shape may comprise one or more linear portions and/or one or more non-linear or curved portions. In some cases, the cross-sectional shape may comprise a T-shape, a cross shape, or an L-shape. In some embodiments, the elongated component may comprise a cylindrical shape or profile. In other embodiments, the elongated component may comprise a rectangular prism.

Attachment Mechanisms

In some embodiments, the apparatus may further comprise one or more attachment mechanisms configured to releasably couple the one or more support members to the one or more additional support members to provide structural support for the main body. In some cases, the one or more attachment mechanisms may comprise a screw or a bolt.

The one or more attachment mechanisms may be insertable through the one or more holes of the additional support members to couple the one or more additional support members to the one or more support members. In some cases, the one or more attachment mechanisms may be configured to limit or restrict a movement of the one or more support members relative to the one or more additional support members (or vice versa) when the one or more attachment mechanisms are inserted through the one or more holes of the one or more additional support members to couple the one or more additional support members to the one or more support members.

Leg Members

In some embodiments, the apparatus may further comprise one or more leg members. In some cases, the one or more leg members may be coupled to or integrated with the one or more attachment mechanisms. In some cases, the one or more attachment mechanisms may be (i) insertable through the one or more holes of the additional support members and (ii) configured to couple the one or more leg members and/or the one or more additional support members to the one or more support members. In some cases, the one or more attachments mechanisms may comprise the one or more leg members. As described elsewhere herein, in some cases, the one or more additional support members of the apparatus may be configured as one or more leg supports that are configured to raise the main body relative to a surface on which the one or more additional support members are placed.

FIG. 4 illustrates an example of an apparatus comprising one or more leg members 106. In some cases, the one or more attachment mechanisms 105 may comprise the one or more leg members 106. In some cases, the one or more attachment mechanisms 105 may be coupled to the one or more leg members 106. In some cases, the one or more leg members 106 may be integrated with the one or more attachment mechanisms 105.

Second Body

In some embodiments, the apparatus may further comprise a second body. The second body may comprise an article of furniture (or a portion or component thereof). The second body may be releasably coupled to the main body to form an article of furniture or a combined article of furniture. In some cases, the combined article of furniture may comprise at least two or more articles of furniture that are attached together. In other cases, the combined article of furniture may comprise at least two or more components or portions of a single article of furniture, which two or more components or portions can be combined or attached together to form the single article of furniture (e.g., an L-shaped sofa).

Figure 8:
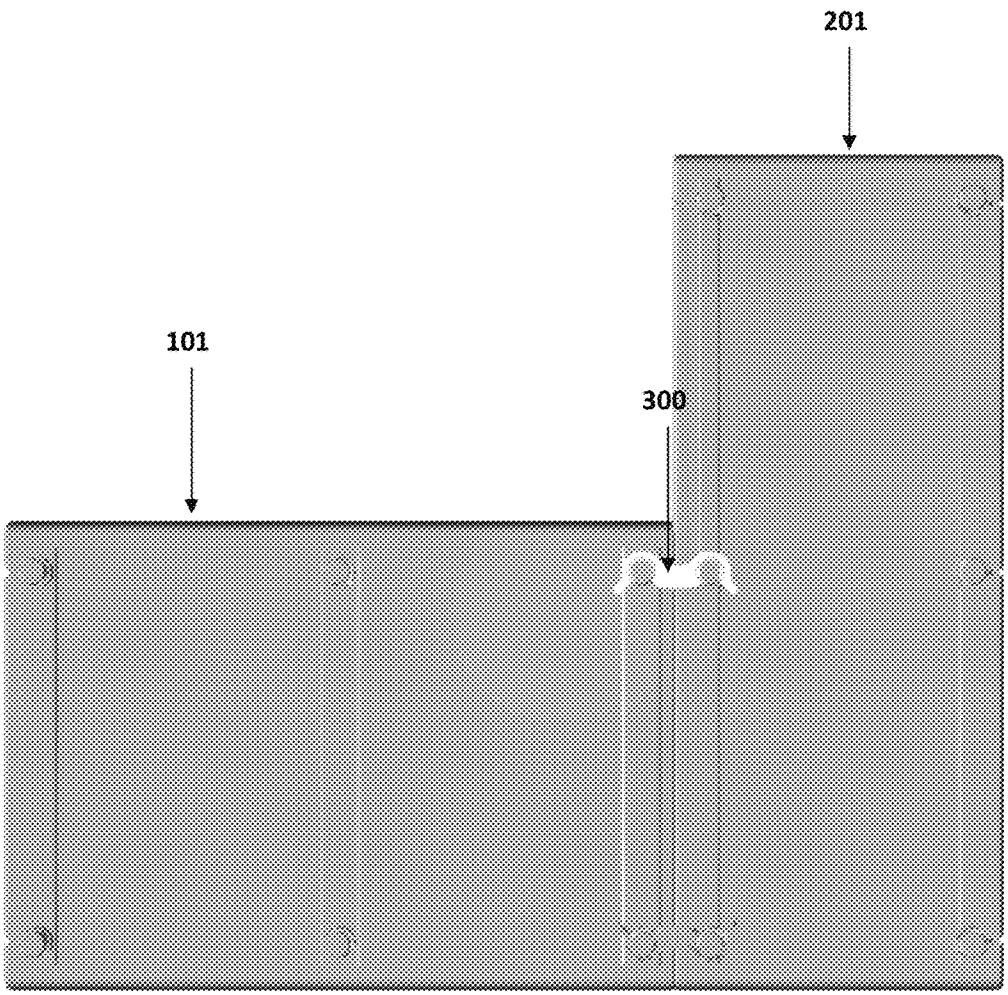
FIG. 8 schematically illustrates an apparatus comprising a main body and a second body that may be releasably coupled using a connector, in accordance with some embodiments.

Examples of an apparatus comprising a main body 101 and a second body 201 are shown in FIGS. 5-8. In some cases, the main body 101 may comprise a first section of a sofa and the second body 201 may comprise a second section of the sofa. The first section of the sofa may extend along a first direction. The second section of the sofa may extend along a second direction that is different than the first direction. The first direction may or may not be perpendicular to the second direction. In some cases, the first direction may be disposed at an angle relative to the second direction. The angle may range from 1 degree to 180 degrees. In some cases, the first section of the sofa may permit a plurality of users to sit along the first direction (e.g., in series or in sequence). In some cases, the second section of the sofa may permit one or more users to sit with their legs extended along the second direction. The main body 101 and the second body 201 may be coupled together using one or more connectors 300, as shown in FIG. 8.

Figure 9:
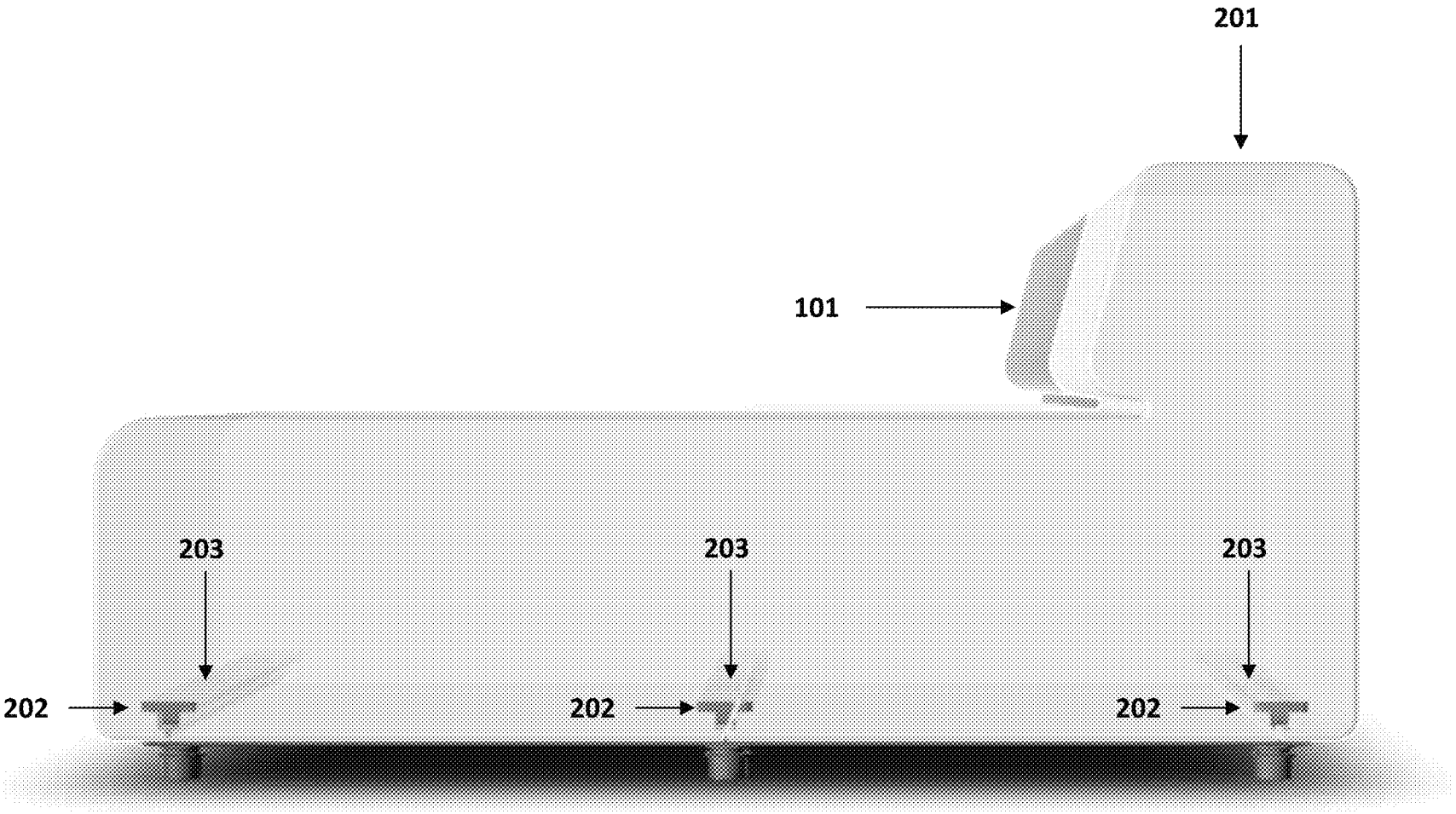
FIGS. 9-11 schematically illustrate one or more lateral support members for the second body and one or more additional lateral support members which may be coupled to the one or more lateral support members using one or more additional attachment mechanisms, in accordance with some embodiments.

Referring to FIG. 9, in some embodiments, the second body 201 may comprise one or more openings or grooves. The one or more openings or grooves 202 may extend along a portion of the second body 201. In some cases, the one or more openings or grooves 202 may extend along a length, a width, and/or a height of the second body 201.

Lateral Support Members

In some embodiments, the apparatus may further comprise one or more lateral support members for the second body. As shown in FIG. 9, one or more lateral support members 203 may be insertable into the one or more openings or grooves 202 of the second body 201.

Additional Lateral Support Members

Figure 10:
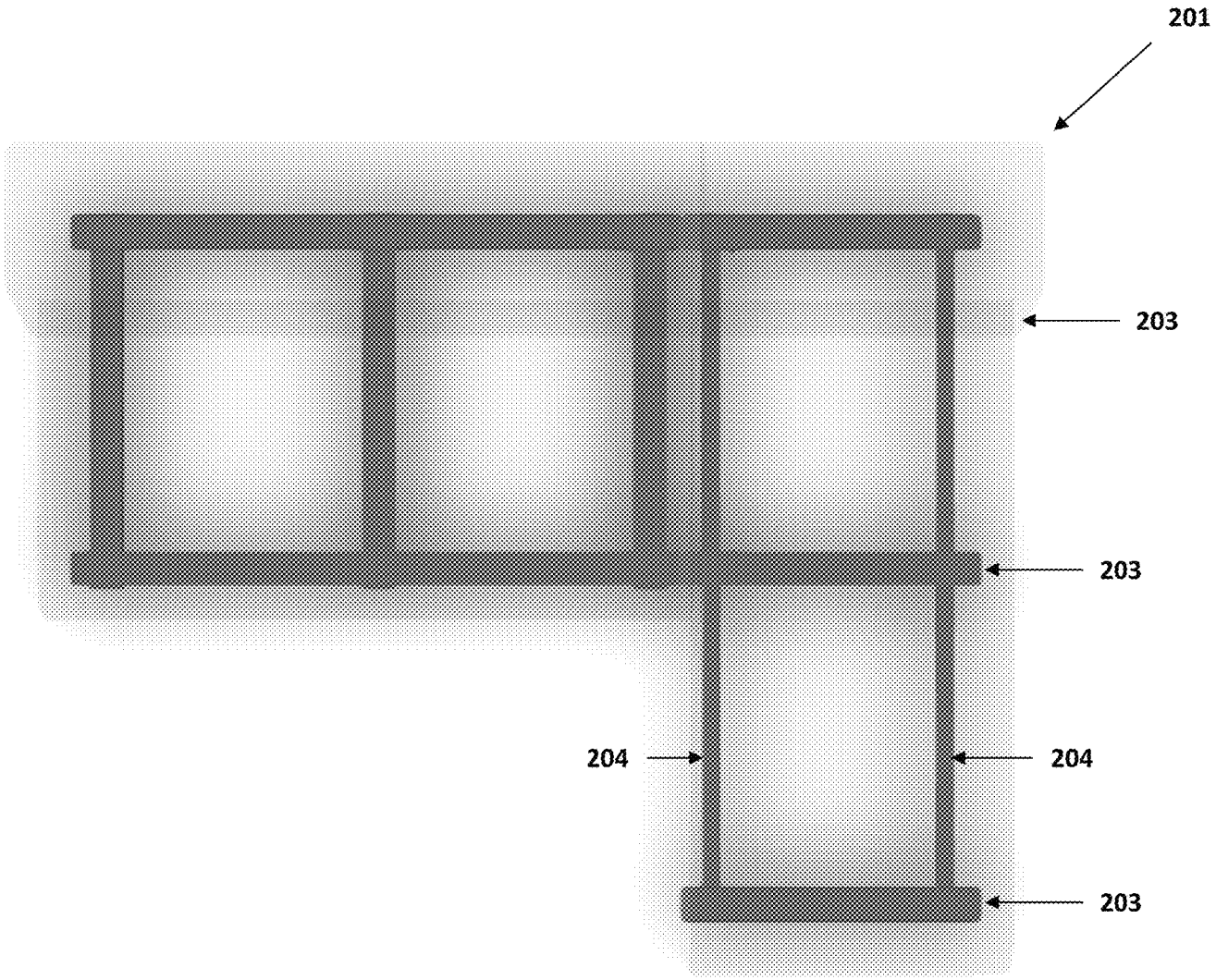
Figure 11:
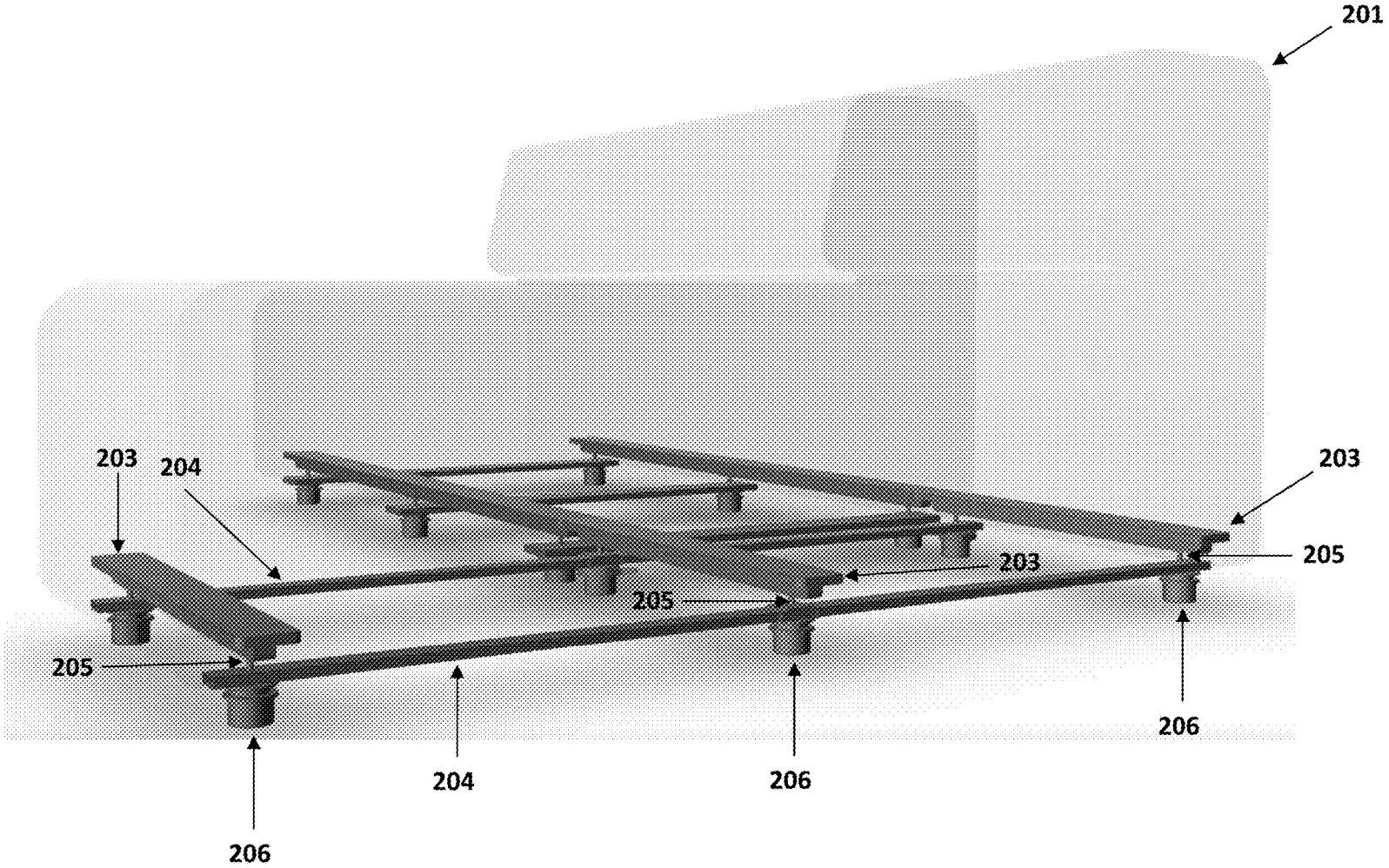

In some embodiments, the apparatus may further comprise one or more additional lateral support members positioned external to or remote from the one or more openings or grooves of the second body. The one or more lateral support members 203 and the one or more additional lateral support member 204 may be used to provide additional structural support for the second body. As shown in FIGS. 10-11, the one or more lateral support members 203 and the one or more additional lateral support members 204 may be coupled to each other using one or more additional attachment mechanisms 205.

Additional Attachment Mechanisms

In some embodiments, the apparatus may further comprise one or more additional attachment mechanisms. The additional attachment mechanisms may be configured to releasably couple the one or more lateral support members for the second body to the one or more additional lateral support members for the second body to provide structural support for the second body. In some cases, the one or more additional attachment mechanisms may comprise a screw or a bolt.

In some cases, the one or more additional attachment mechanisms may be (i) insertable through one or more holes of the one or more additional lateral support members and (ii) configured to couple one or more additional leg members and/or the one or more additional lateral support members to the one or more lateral support members for the second body.

Additional Leg Members

In some embodiments, the apparatus may further comprise one or more additional leg members coupled to or integrated with the one or more additional attachment mechanisms. In other embodiments, the one or more additional attachment mechanisms described above may comprise the one or more additional leg members. Alternatively, the one or more additional lateral support members may be configured as one or more additional leg supports that raise the second body relative to a surface on which the one or more additional lateral support members are placed.

Referring back to FIGS. 10-11, in some embodiments, the apparatus may comprise one or more additional leg members 206. In some cases, the one or more additional attachment mechanisms 205 may comprise the one or more additional leg members 206. In some cases, the one or more additional attachment mechanisms 205 may be coupled to the one or more additional leg members 206. In some cases, the one or more additional leg members 206 may be integrated with the one or more additional attachment mechanisms 205.

Connectors

In some embodiments, the apparatus may further comprise one or more connectors configured to releasably couple the main body or a component thereof to the second body or a component thereof. In some cases, the one or more connectors may comprise a latch. The latch may be configured to releasably couple at least a portion of the main body (e.g., a leg member of the main body) to at least a portion of the second body (e.g., a leg member of the second body). Such coupling may serve to limit or restrict a movement of the main body relative to the second body.

FIG. 8 illustrates an exemplary configuration in which the main body 101 and the second body 201 can be coupled together using one or more connectors 300. In some cases, a plurality of connectors may be used to couple multiple portions of the main body and the second body together. In other cases, the plurality of connectors may be used to couple (i) multiple components that are integrated with or coupled to the main body and (ii) multiple components that are integrated with or coupled to the second body. Such coupling may comprise, for example, a releasable coupling that can be engaged or disengaged by a physical motion (e.g., a twist, a turn, a push, a pull, or any other lateral or rotational motion in three-dimensional space).

In some cases, the connectors may comprise a locking mechanism. The locking mechanism may permit a user to selectively lock portions of the main body and the second body relative to each other to restrict a movement of the main body relative to the second body, or vice versa. The locking mechanism may permit a user to provide an input (e.g., a pushing force, or in some alternative embodiments, a pulling force or a rotational force) to unlock the one or more connectors, thereby allowing a relative movement of the main body relative to the second body. In some cases, the locking mechanism may lock or restrict a movement of the main body and the second body when a user provides a first input to lock the locking mechanism, and may subsequently permit a movement of the main body relative to the second body (or vice versa) when the user provides a second input to unlock the locking mechanism. The first input and the second input may comprise counteracting movements or movements in an opposite/reverse direction. In some cases, the first input and the second input may comprise similar inputs or types of inputs.

Leg Supports

Figure 12:
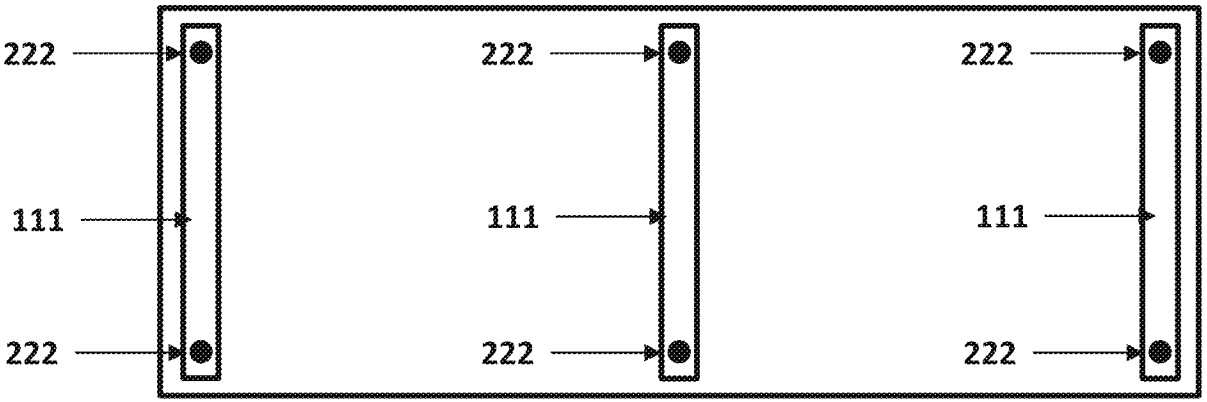
FIG. 12 schematically illustrates one or more support members that may be configured as leg supports to raise a body of an article of furniture relative to a surface on which the article of furniture is placed, in accordance with some embodiments.

In any of the embodiments described herein, the support members, the additional support members, the lateral support members, and/or the additional lateral support members may be configured as leg supports that raise the main body or the second body from the ground or surface on which the support members are placed. FIG. 12 illustrates a bottom view of an apparatus comprising one or more members 111 which may be configured as one or more leg supports. The one or more leg supports may be configured to raise the first body and/or the second body relative to a surface on which the one or more members 111 are placed.

In some embodiments, the one or more members 111 may comprise the one or more additional support members 104 (e.g., as shown in FIG. 3) or the one or more additional lateral support members 204 (e.g., as shown in FIG. 11). In any case, the one or more members 111 may comprise one or more structural members or beams that are located outside of, external to, or remote from the one or more openings or grooves of the main body or the second body. The one or more members 111 may be coupled to the one or more support members 103 (e.g., as shown in FIG. 3) or the one or more lateral support members 203 (e.g., as shown in FIG. 11) using one or more attachment mechanisms 222. The one or more attachment mechanisms 222 may comprise, for example, a bolt or a screw. In some cases, the one or more attachment mechanisms 222 may comprise a support (e.g., a padding or an elastomeric material) to prevent damage to the one or more members 111 or the surface on which the one or more members 111 are placed.

Armrest

Figure 14:
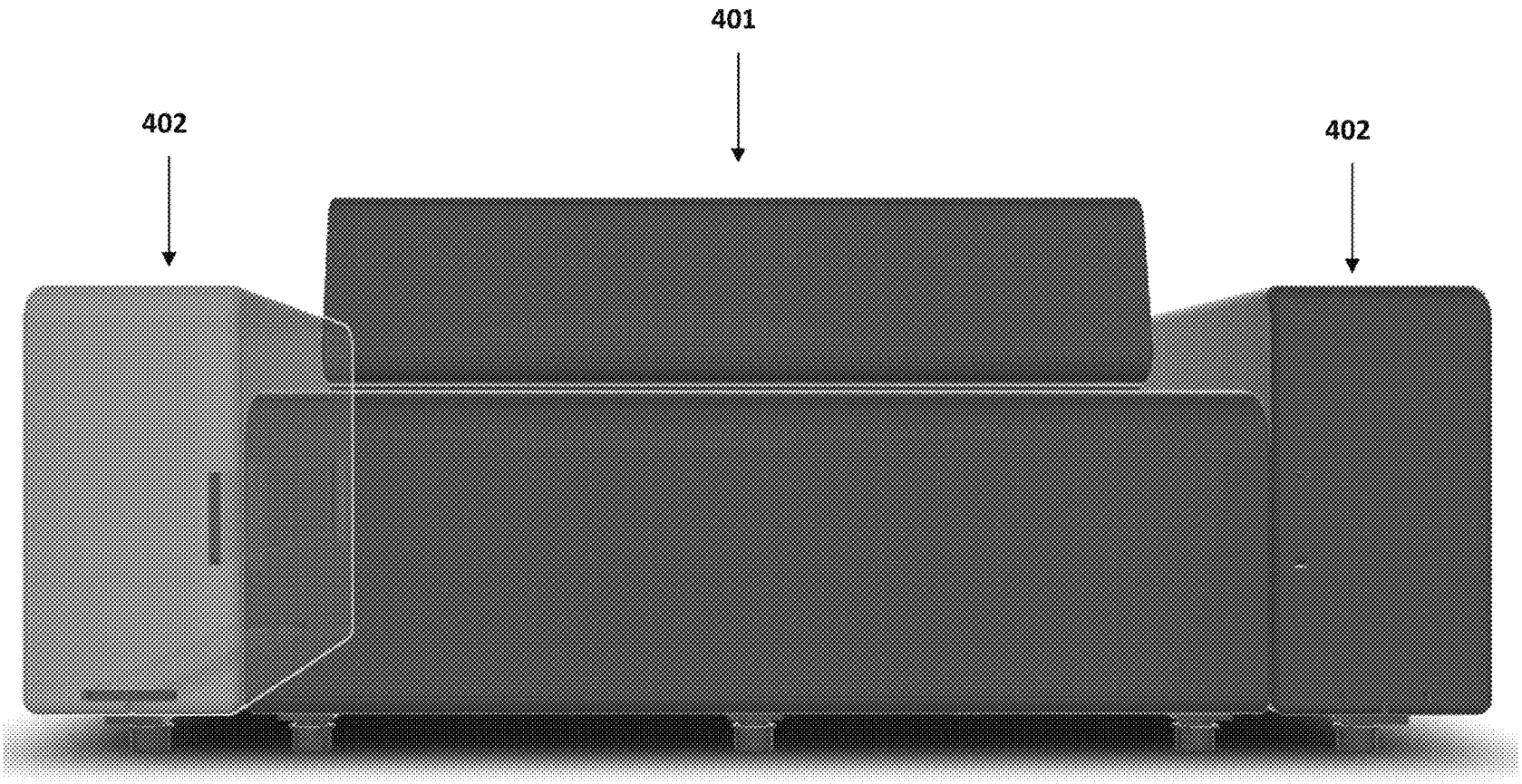

In another aspect, the present disclosure provides an apparatus comprising a main body, one or more armrests, and one or more connecting mechanisms for coupling or securing the one or more armrests to the main body (e.g., directly or indirectly by way of one or more intermediary components coupled to or inserted within the main body). In some embodiments, the one or more connecting mechanisms may be configured to couple or secure the one or more armrests to one or more structural components inserted through or within one or more grooves or openings of the main body. Further, in some embodiments, at least a portion of the one or more connecting mechanisms may be insertable into one or more grooves or openings of the one or more armrests. FIGS. 13-14 illustrate an example of an apparatus comprising a main body 401 and one or more armrests 402. The one or more armrests 402 may be integrated with or releasably coupled to the main body 401. In any of the embodiments described herein, the main body and/or the one or more armrests may comprise a foam material. In some cases, the foam material may be vacuum packable.

Connecting Mechanism/Wedges/Plates

Figure 15:
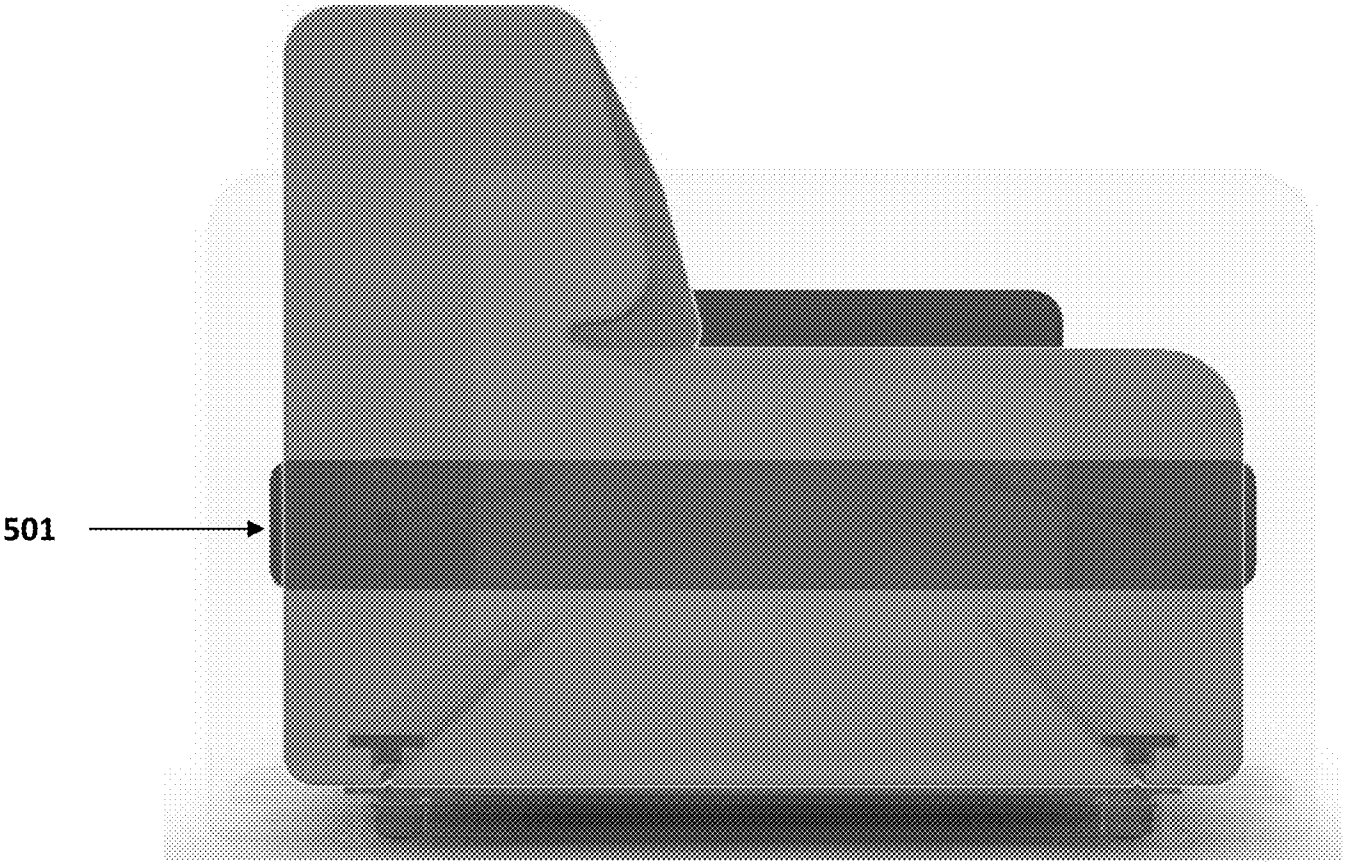
FIGS. 15-17 schematically illustrate one or more plates that are insertable into one or more armrests of the apparatus, in accordance with some embodiments.
Figure 16:
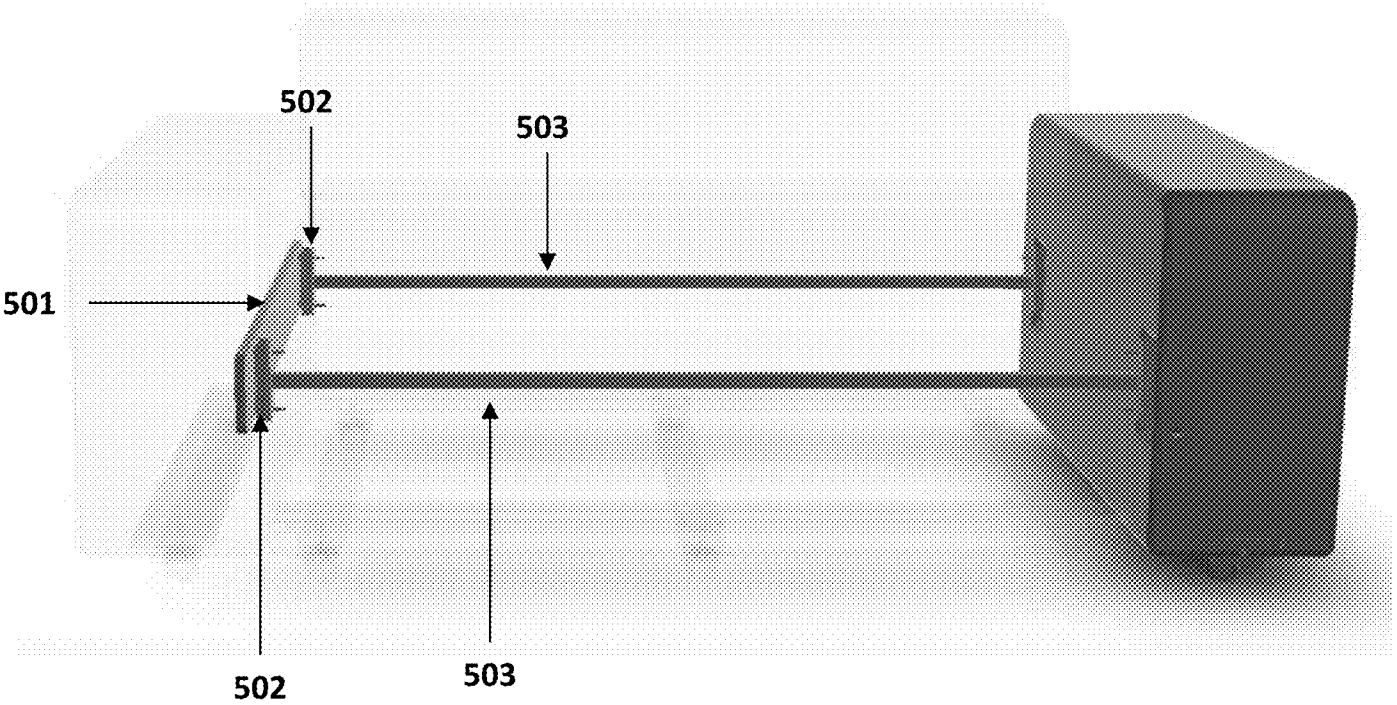
Figure 17:
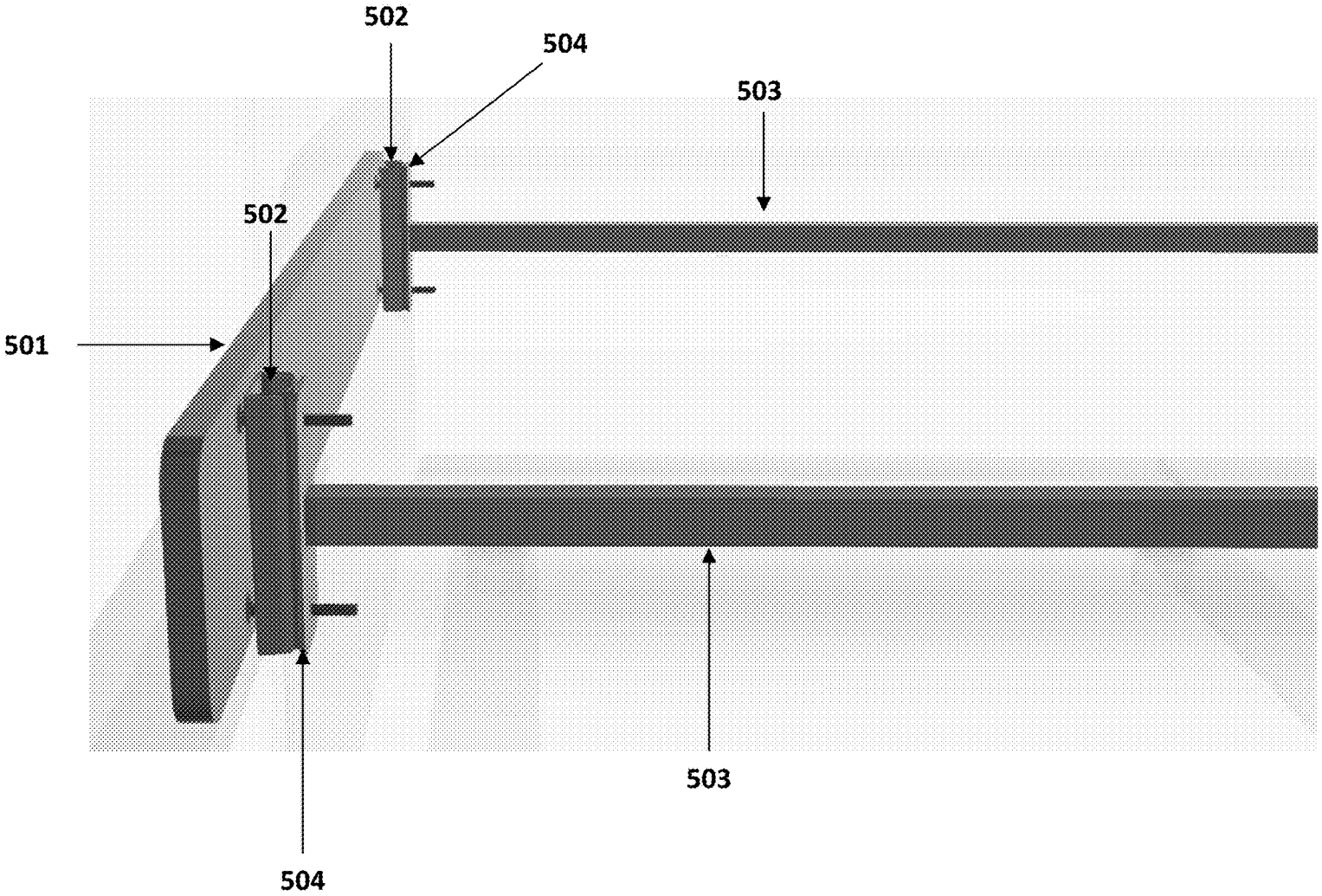

In some cases, the connecting mechanism may comprise one or more wedges. The one or more wedges may be secured to one or more plates which are insertable into the one or more armrests (e.g., through one or more openings or grooves in the armrests) to provide additional structural support for the one or more armrests. FIG. 15 shows an example of one or more plates 501 which are insertable into the one or more armrests to provide additional structural support for the one or more armrests. FIGS. 16-17 show an exemplary configuration in which one or more wedges 502 may be secured to the one or more plates 501 that are insertable into the one or more armrests to provide additional structural support for the one or more armrests. The wedges may be configured to latch on or couple to (i) a portion of the main body, (ii) one or more structural components within the main body, or (iii) one or more components inserted through/within the main body (e.g., through or within one or more grooves or openings provided in the main body), in order to secure the one or more plates and lock a position and/or an orientation of the one or more plates within the one or more armrests. In some embodiments, the wedges 502 secured to the one or more plates 501 may couple to a set of wedges 504 attached to one or more support members 503 provided within or inserted through the main body.

In some embodiments, the main body (or the one or more structural components inserted through or within one or more grooves of the main body) may comprise or may be coupled to an additional set of wedges 504 configured to engage with the one or more wedges 502 secured to the one or more plates 501 in order to limit or restrict a movement of the one or more armrests relative to the main body. In some embodiments, the one or more plates 501 and/or the one or more wedges 502 secured to the one or more plates 501 may be coupled or attached to one or more structural components of the main body or the overall apparatus (i.e., article of furniture) to provide additional support for the main body or the overall apparatus.

Support Members

In some embodiments, the apparatus may comprise one or more support members that are insertable into one or more grooves or openings in the main body to provide additional structural support for the main body or a portion thereof. In some cases, the one or more support members may extend along a length of the main body. In other cases, the one or more support members may extend along a width of the main body. In any of the embodiments described herein, the one or more support members may comprise a beam or a bar that extends through at least a portion of the main body. In any of the embodiments described herein, the one or more support members may comprise a beam or a bar that is coupled or attached to at least a portion of the main body. FIGS. 16-17 illustrate one or more support members 503 provided within the main body. The one or more support members 503 may be coupled to a set of wedges 504 that are configured to receive and/or engage with the wedges 502 secured to the one or more plates 501 to releasably attach the support members 503 to the one or more plates 501. In some embodiments, the one or more plates 501 may be configured to couple to the one or more support members 503 of the main body to limit or restrict a movement of the one or more armrests relative to the main body or the support members. In some embodiments, one or more additional wedges 504 may be coupled or attached to the distal ends of the one or more support members 503. FIG. 17 illustrates an example of support members 503 having one or more additional wedges 504 attached thereto using a fastener (e.g., a bolt or a screw).

Figure 18:
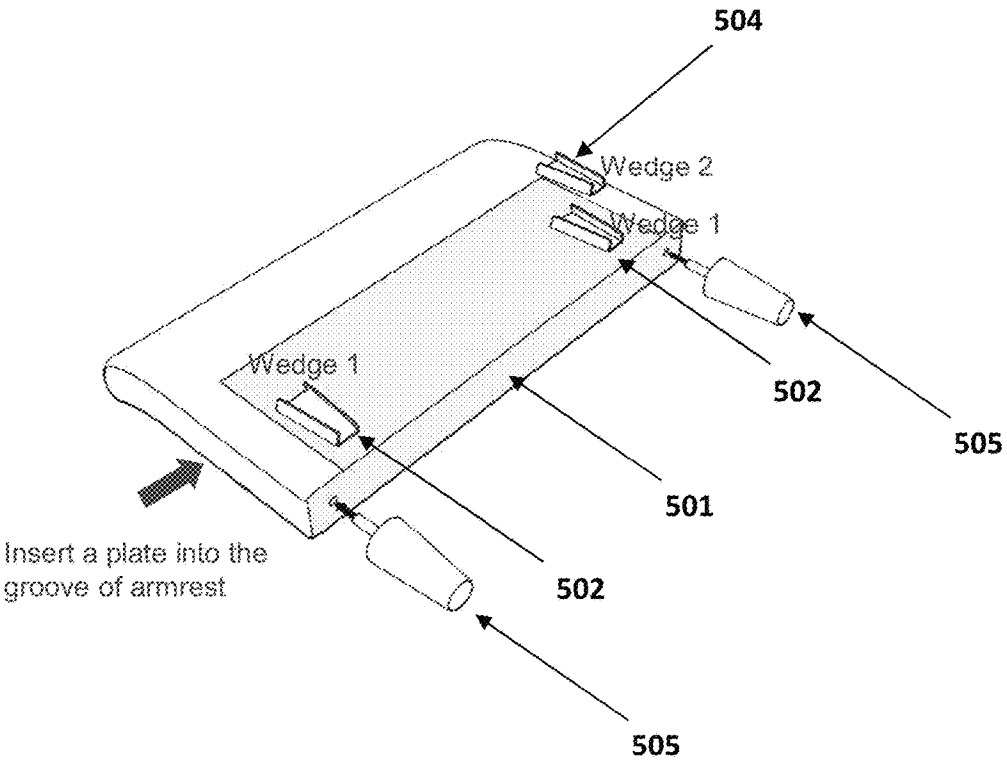
FIG. 18 schematically illustrates an example of a plate that can be inserted into a groove of an armrest, in accordance with some embodiments.

FIG. 18 illustrates another example of a plate 501 which may be inserted into an armrest (e.g., through or within one or more grooves or openings provided in the armrest). The plate 501 may be inserted into a groove or an opening in the armrest. In some cases, the plate 501 may be inserted vertically into the armrest. In other cases, the plate 501 may be inserted laterally into the armrest.

In some cases, one or more wedges 502 may be coupled or attached to the plate 501. The one or more wedges 502 may be configured to interface with and/or couple to a set of wedges 504 secured to the support members 503 illustrated in FIGS. 16-17.

In some embodiments, one or more leg support members 505 may be coupled to the plate 501. In some embodiments, one or more attachment mechanisms as described elsewhere herein may be used to couple the plate 501 to one or more structural members of an article of furniture.

As described elsewhere herein, the one or more structural members may comprise structural members which may be inserted into one or more grooves or openings in a main body of the article of furniture, or in the alternative, structural members provided outside of or external to such grooves or openings in the main body of the article of furniture.

Examples

Figure 19:
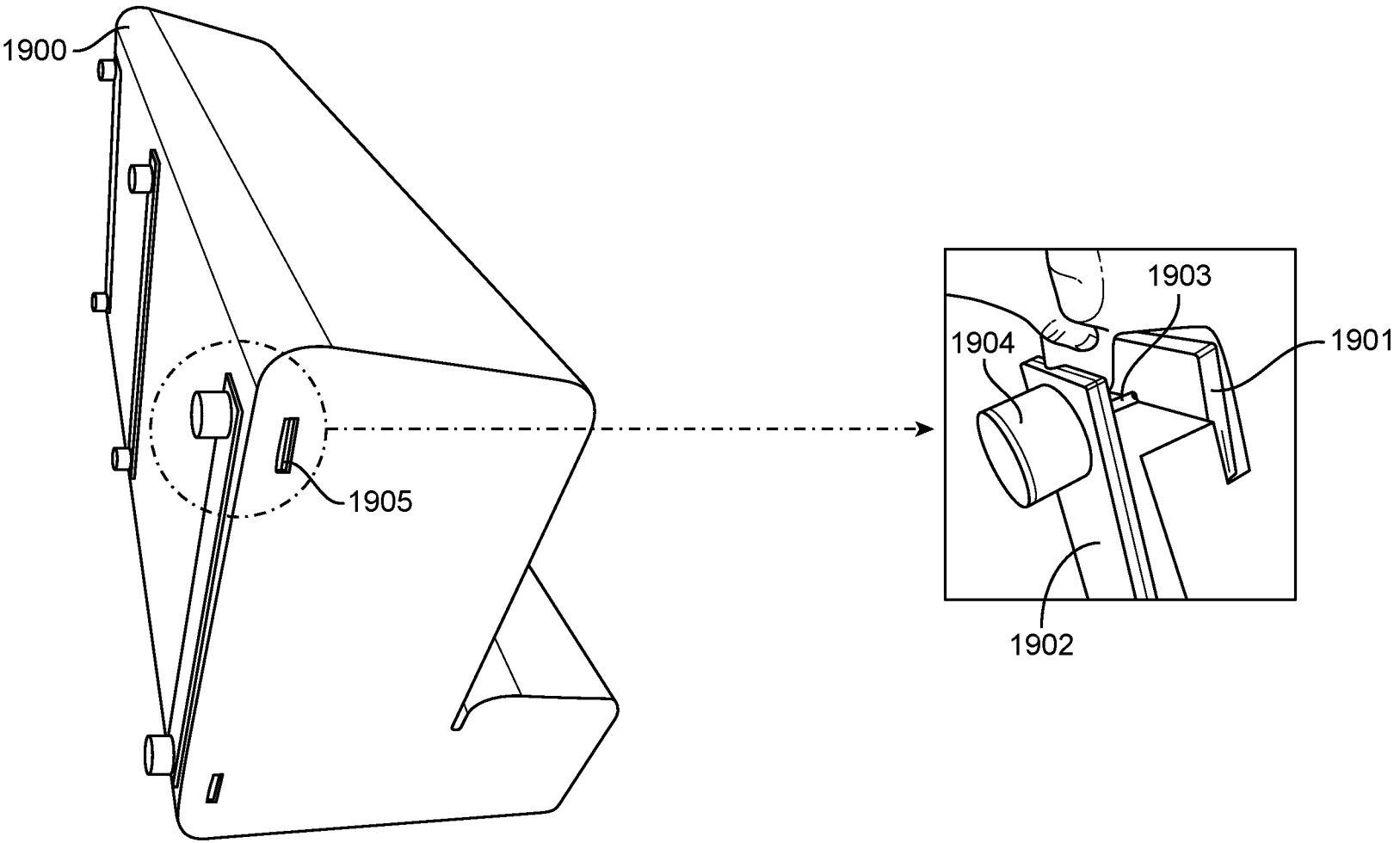
FIG. 19 schematically illustrates an example of a first plate that is inserted into an opening within a foam body and a second plate that is coupled to the first plate using an attachment mechanisms, in accordance with some embodiments.

FIG. 19 schematically illustrates an example of a first plate 1901 that is inserted into an opening 1905 within a foam body 1900 and a second plate 1902 that is coupled to the first plate 1901 using an attachment mechanism 1903. The attachment mechanism 1903 may comprise, for example, a screw or a bolt. In some cases, a leg support 1904 may be coupled to or integrated with the attachment mechanism 1903. The leg support 1904 may be configured to lift the body of the article of furniture from the ground.

FIG. 20 schematically illustrates another example of a first plate 2001 that is insertable into an opening within a foam body and a second plate 2002 that is (i) positioned outside of the opening within the foam body and (ii) coupled to the first plate 2001 using an attachment mechanism. In some cases, the first plate 2001 may have a T-shaped cross-section. The T-shaped cross-section may provide additional material through which the attachment mechanism can be inserted to couple the first plate 2001 to the second plate 2002. This may provide additional stability and may allow for a more secure attachment of the first plate 2001 to the second plate 2002.

Methods

In another aspect, the present disclosure provides a method for assembling an article of furniture. The method may comprise (a) providing an article of furniture, which article of furniture may comprise a main body comprising one or more openings or grooves. In some cases, the one or more openings or grooves of the main body may be formed by foam auto cutting. In some embodiments, the method may further comprise (b) inserting one or more support members into the one or more openings or grooves of the main body. In some embodiments, the method may further comprise (c) releasably coupling one or more additional support members to the one or more support members using one or more attachment mechanisms in order to provide structural support for the main body. The one or more additional support members may be positioned external to or remote from the one or more openings or grooves.

In some embodiments, the article of furniture may comprise a sofa, a loveseat, or a chair. In some embodiments, the main body may comprise a foam material. In some embodiments, the main body may be vacuum packable.

The one or more attachment mechanisms described herein may comprise, for example, a screw or a bolt. In any of the embodiments described herein, the one or more attachment mechanisms may be (i) insertable through one or more holes in the additional support members and (ii) configured to couple the one or more additional support members to the one or more support members.

In some embodiments, the method may further comprise using one or more connectors to releasably couple the main body to a second body. The second body may correspond to (i) another portion of the article of furniture or (ii) another separate or distinct article of furniture. In some cases, the one or more connectors may comprise a latch configured to releasably couple at least one leg member of the main body to at least one leg member of the second body to limit or restrict a movement of the main body relative to the second body.

In some embodiments, one or more plates may be inserted into one or more armrests of the main body to provide structural support for the one or more armrests. In some cases, the one or more plates may have one or more wedges secured thereto. In some cases, the one or more wedges may be configured to couple to one or more support members inserted within the main body to limit or restrict a movement of the one or more armrests relative to the main body.

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

What is claimed is:

1. An apparatus, comprising:

a main body comprising one or more openings or grooves;

one or more support members that are insertable into the one or more openings or grooves of the main body;

one or more additional support members positioned external to or remote from the one or more openings or grooves of the main body;

one or more attachment mechanisms configured to releasably couple the one or more support members to the one or more additional support members to provide structural support for the main body;

a second body comprising one or more openings or grooves;

one or more lateral support members that are insertable into the one or more openings or grooves of the second body; and one or more connectors configured to releasably couple the main body to the second body.

2. The apparatus of claim 1, wherein the one or more additional support members comprise one or more holes through which at least a portion of the one or more attachment mechanisms is insertable.

3. The apparatus of claim 2, wherein the one or more attachment mechanisms are insertable through the one or more holes of the additional support members to couple the one or more additional support members to the one or more support members.

4. The apparatus of claim 1, further comprising one or more leg members coupled to or integrated with the one or more attachment mechanisms.

5. The apparatus of claim 4, wherein the one or more attachment mechanisms are (i) insertable through the one or more holes of the additional support members and (ii) configured to couple the one or more leg members and/or the one or more additional support members to the one or more support members.

6. The apparatus of claim 4, wherein the one or more attachments mechanisms comprise the one or more leg members.

7. The apparatus of claim 1, wherein the one or more additional support members are configured as one or more leg supports that raise the main body relative to a surface on which the one or more additional support members are placed.

8. The apparatus of claim 1, wherein the one or more attachment mechanisms comprise a screw or a bolt.

9. The apparatus of claim 1, wherein the one or more support members are positioned and oriented at an angle relative to the one or more additional support members.

10. The apparatus of claim 9, wherein the one or more support members are perpendicular or orthogonal to the one or more additional support members.

11. The apparatus of claim 1, wherein the one or more attachment mechanisms are configured to limit or restrict a movement of the one or more support members relative to the one or more additional support members when the one or more attachment mechanisms are inserted through the one or more holes of the one or more additional support members to couple the one or more additional support members to the one or more support members.

12. An apparatus, comprising:

a main body comprising one or more openings or grooves;

one or more support members that are insertable into the one or more openings or grooves of the main body;

one or more additional support members positioned external to or remote from the one or more openings or grooves of the main body;

one or more attachment mechanisms configured to releasably couple the one or more support members to the one or more additional support members to provide structural support for the main body;

a second body comprising one or more openings or grooves;

one or more lateral support members that are insertable into the one or more openings or grooves of the second body;

one or more connectors configured to releasably couple the main body to the second body;

one or more additional lateral support members positioned external to or remote from the one or more openings or grooves of the second body; and one or more additional attachment mechanisms configured to releasably couple the one or more lateral support members to the one or more additional lateral support members to provide structural support for the second body.

13. The apparatus of claim 12, wherein the one or more additional attachment mechanisms comprise a screw or a bolt.

14. The apparatus of claim 12, further comprising one or more additional leg members coupled to or integrated with the one or more additional attachment mechanisms.

15. The apparatus of claim 14, wherein the one or more additional attachment mechanisms are (i) insertable through one or more holes of the one or more additional lateral support members and (ii) configured to couple the one or more additional leg members and/or the one or more additional lateral support members to the one or more lateral support members.

16. The apparatus of claim 14, wherein the one or more additional attachment mechanisms comprise the one or more additional leg members.

17. The apparatus of claim 12, wherein the one or more additional lateral support members are configured as one or more additional leg supports that raise the second body relative to a surface on which the one or more additional lateral support members are placed.

18. The apparatus of claim 1, wherein the one or more connectors comprise a latch.

19. The apparatus of claim 18, wherein the latch is configured to releasably couple at least one leg member of the main body to at least one leg member of the second body to limit or restrict a movement of the main body relative to the second body.

20. The apparatus of claim 1, wherein the main body comprises a foam material.

21. The apparatus of claim 1, wherein the main body is vacuum packable.

22. The apparatus of claim 1, wherein the main body comprises at least a portion of an article of furniture.

23. The apparatus of claim 22, wherein the article of furniture comprises a sofa, a loveseat, or a chair.

* * * * *